US009877631B2

(12) United States Patent
Patterson et al.

(10) Patent No.: US 9,877,631 B2
(45) Date of Patent: Jan. 30, 2018

(54) HARD SURFACE CLEANING DEVICES

(71) Applicant: Unger Marketing International, LLC, Bridgeport, CT (US)

(72) Inventors: Joseph K. Patterson, Monroe, CT (US); James M. Buckley, New Hartford, CT (US); John Lombardo, Ridgefield, CT (US); Stephen Huda, Shelton, CT (US); Paul H. Adams, Monroe, CT (US); Bryan Lee Roberts, Jr., Dormagen (DE); Frank Wilde, Essen (DE)

(73) Assignee: UNGER MARKETING INTERNATIONAL, LLC, Bridgeport, CT (US)

( * ) Notice: Subject to any disclaimer, the term of this patent is extended or adjusted under 35 U.S.C. 154(b) by 98 days.

(21) Appl. No.: 14/983,883

(22) Filed: Dec. 30, 2015

(65) Prior Publication Data

US 2016/0374532 A1 Dec. 29, 2016

Related U.S. Application Data

(60) Provisional application No. 62/185,382, filed on Jun. 26, 2015.

(51) Int. Cl.
*B08B 3/00* (2006.01)
*A47L 13/22* (2006.01)
(Continued)

(52) U.S. Cl.
CPC ..... *A47L 13/22* (2013.01); *A46B 11/001* (2013.01); *A46B 11/002* (2013.01); *A47L 1/08* (2013.01);
(Continued)

(58) Field of Classification Search
None
See application file for complete search history.

(56) References Cited

U.S. PATENT DOCUMENTS 2,104,161 A 12/1934 Koukal
4,776,716 A 10/1988 Huang
(Continued)

FOREIGN PATENT DOCUMENTS

CA 2730814 A1 8/2011
CA 2893297 6/2014

OTHER PUBLICATIONS

HooverTwinTank_2011_Manual, 13 pages, 2011.
(Continued)

*Primary Examiner* — Eric Golightly
(74) *Attorney, Agent, or Firm* — Ohlandt, Greeley, Ruggiero & Perle, L.L.P.

(57) ABSTRACT

A cleaning device is provided that includes a housing, a cleaning head, a flexible pouch, a cleaning element, and a spray nozzle. The housing defines an internal cavity having a power source in selective electrical communication with a pump. The flexible pouch is removably stored in the housing and includes a cleaning fluid therein. The pouch forms a fluid and air tight connection with an inlet of the pump. The cleaning element is connected to the cleaning head and has a first spray opening. The spray nozzle is in fluid communication with an outlet of the pump. The spray nozzle is positioned on the cleaning head so as to spray the cleaning fluid from the flexible pouch through the first opening onto a surface being cleaned.

36 Claims, 22 Drawing Sheets

(51) Int. Cl.

| | |
|---|---|
| ***A46B 11/00*** | (2006.01) |
| ***A47L 1/08*** | (2006.01) |
| ***A47L 13/44*** | (2006.01) |
| ***B08B 1/00*** | (2006.01) |
| *B08B 3/02* | (2006.01) |

(52) U.S. Cl.
CPC ..... *A47L 13/44* (2013.01); *B08B 1/00* (2013.01); *B08B 3/026* (2013.01)

(56) References Cited

U.S. PATENT DOCUMENTS

| | | | |
|---|---|---|---|
| 4,863,299 | A | 9/1989 | Osberghaus et al. |
| 5,271,682 | A | 12/1993 | Realdon |
| 5,735,620 | A | 4/1998 | Ford |
| 5,888,006 | A | 3/1999 | Ping et al. |
| 6,142,750 | A | 11/2000 | Benecke |
| 6,497,525 | B1 | 12/2002 | Huang |
| 6,540,424 | B1 | 4/2003 | Hall et al. |
| 6,551,001 | B2 | 4/2003 | Aberegg et al. |
| 6,579,023 | B2 | 6/2003 | Kunkler et al. |
| 6,612,768 | B2 | 9/2003 | Zorzo |
| 6,655,866 | B1 | 12/2003 | Morad et al. |
| 6,659,670 | B1 | 12/2003 | Blouse |
| 6,663,306 | B2 | 12/2003 | Policicchio et al. |
| 6,669,391 | B2 | 12/2003 | Policicchio et al. |
| 6,722,806 | B2 | 4/2004 | Kunkler et al. |
| 6,726,388 | B1 | 4/2004 | Monahan |
| 6,854,911 | B2 | 2/2005 | Policicchio et al. |
| 6,854,912 | B2 | 2/2005 | Dyer et al. |
| 6,893,180 | B2 | 5/2005 | Hall et al. |
| 6,899,485 | B2 | 5/2005 | Hall et al. |
| 6,953,299 | B2 | 10/2005 | Wang et al. |
| 6,960,042 | B1 | 11/2005 | Hsiao |
| 6,964,535 | B2 | 11/2005 | Bell et al. |
| 6,981,533 | B2 | 1/2006 | Lorzo |
| 6,986,618 | B2 | 1/2006 | Hall et al. |
| 6,986,619 | B2 | 1/2006 | Hall et al. |
| 7,004,658 | B2 | 2/2006 | Hall et al. |
| 7,048,458 | B2 | 5/2006 | Hall et al. |
| 7,048,804 | B2 | 5/2006 | Kisela et al. |
| 7,056,050 | B2 | 6/2006 | Sacks |
| 7,159,275 | B2 | 1/2007 | Chang |
| 7,160,044 | B2 | 1/2007 | Dyer et al. |
| 7,163,349 | B2 | 1/2007 | Policicchio et al. |
| 7,172,099 | B2 | 2/2007 | Hofte et al. |
| 7,191,486 | B1 | 3/2007 | Michelson et al. |
| 7,431,524 | B2 | 10/2008 | Sacks |
| 7,530,136 | B1 | 5/2009 | Ball |
| 7,618,206 | B2 | 11/2009 | Sacks |
| 7,699,551 | B2 | 4/2010 | Suda et al. |
| 7,708,485 | B2 | 5/2010 | Tanaka et al. |
| 7,722,273 | B2 | 5/2010 | Tanaka et al. |
| 7,850,384 | B2 | 12/2010 | Sacks |
| 8,069,520 | B2 | 12/2011 | Mattucci et al. |
| 8,079,770 | B2 | 12/2011 | Widmer et al. |
| 8,096,723 | B2 | 1/2012 | Bae |
| 8,109,685 | B1 | 2/2012 | Vito |
| 8,186,898 | B2 | 5/2012 | Bradbury et al. |
| 8,205,293 | B2 | 6/2012 | Rosenzweig et al. |
| 8,241,427 | B1 | 8/2012 | Crawford et al. |
| 8,267,607 | B2 | 9/2012 | Harris |
| 8,425,137 | B1 | 4/2013 | Sampaio |
| 8,449,212 | B2 | 5/2013 | Crawford et al. |
| 8,596,896 | B2 | 12/2013 | Kimura |
| 8,641,309 | B2 | 2/2014 | Perry et al. |
| 8,662,778 | B2 | 3/2014 | Crawford et al. |
| 8,667,637 | B2 | 3/2014 | Vrdoljak et al. |
| 8,807,858 | B2 | 8/2014 | Fitzpatrick et al. |
| 8,834,053 | B2 | 9/2014 | Van Landingham, Jr. et al. |
| 8,844,088 | B2 | 9/2014 | Garcia Castillo |
| 8,894,315 | B2 | 11/2014 | Dingert et al. |
| 8,926,210 | B2 | 1/2015 | Orubor |
| 8,927,480 | B2 | 1/2015 | Williams et al. |
| 9,044,132 | B2 | 6/2015 | Kaminer et al. |
| 2003/0103795 | A1 | 6/2003 | Hollars et al. |
| 2003/0126710 | A1 | 7/2003 | Policicchio et al. |
| 2004/0146333 | A1 | 7/2004 | Fu |
| 2004/0223803 | A1 | 11/2004 | Fahy et al. |
| 2005/0031404 | A1 | 2/2005 | Tsai et al. |
| 2005/0089360 | A1 | 4/2005 | Garabedian, Jr. et al. |
| 2005/0191116 | A1 | 9/2005 | Flanery et al. |
| 2006/0039743 | A1 | 2/2006 | Mensink et al. |
| 2006/0110207 | A1 | 5/2006 | Augustinus Hofte et al. |
| 2006/0213017 | A1 | 9/2006 | Bele et al. |
| 2007/0140774 | A1 | 6/2007 | Dyer et al. |
| 2007/0231046 | A1 | 10/2007 | Whiffen et al. |
| 2008/0038045 | A1 | 2/2008 | Hofte et al. |
| 2008/0066242 | A1 | 3/2008 | Aiyar |
| 2008/0205972 | A1 | 8/2008 | LaFlamme et al. |
| 2011/0158740 | A1 | 6/2011 | Kandasamy et al. |
| 2012/0227763 | A1 | 9/2012 | Hayes et al. |
| 2013/0263396 | A1 | 10/2013 | Crawford et al. |
| 2013/0263398 | A1 | 10/2013 | Irwin et al. |
| 2014/0317868 | A1 | 10/2014 | Fitzpatrick et al. |
| 2015/0082570 | A1 | 3/2015 | Davidshofer et al. |
| 2015/0089757 | A1 | 4/2015 | Davidshofer et al. |
| 2015/0101140 | A1 | 4/2015 | Pierce |

OTHER PUBLICATIONS

International Search Report and Written Opinion dated Feb. 25, 2016 for corresponding International Patent pplication No. PCT/US2015/068212, 8 pages.

HARD SURFACE CLEANING DEVICES

CROSS REFERENCE TO RELATED APPLICATIONS

This application claims the benefit of U.S. Provisional Application Ser. No. 62/185,382 filed Jun. 26, 2015, the contents of which are incorporated by reference herein.

BACKGROUND

1. Field of the Disclosure

The present disclosure is related to cleaning devices. More particularly, the present disclosure is related to cleaning devices that spray cleaning fluids to assist the cleaning of hard surfaces.

2. Description of Related Art

Cleaning devices that allow for the cleaning of hard surfaces such as, but not limited to, window, walls, counters, floors, mirrors, tiles, tables, and others are known. Some prior art cleaning devices are also known to include cleaning fluid spraying systems—that allow the user to spray cleaning fluid onto the surface to be cleaned.

However, it has been determined by the present disclosure that such prior art cleaning devices are less than optimal. For example, prior art cleaning devices typically require the user to manually refill the cleaning fluid reservoir, providing the opportunity for the user to inadvertently spill or come into contact with the cleaning fluid. Additionally, prior art cleaning devices are often limited to a single cleaning task—namely are not adjustable in one or more of the shape and/or size of the cleaning head and/or the length of the device.

Accordingly, there is a need for improved hard surface cleaning devices that improve upon, overcome, alleviate, and/or mitigate the deleterious effects and inefficiencies of prior art devices.

SUMMARY

A cleaning device is provided that includes a housing, a cleaning head, a flexible pouch, a cleaning element, and a spray nozzle. The housing defines an internal cavity having a power source in selective electrical communication with a pump. The flexible pouch is removably stored in the housing and includes a cleaning fluid therein. The pouch forms a fluid and air tight connection with an inlet of the pump. The cleaning element is connected to the cleaning head and has a second spray opening in registration with the first spray opening. The spray nozzle is in fluid communication with an outlet of the pump. The spray nozzle is positioned on the cleaning head so as to spray the cleaning fluid from the flexible pouch through the first spray opening onto a surface being cleaned.

The above-described and other features and advantages of the present disclosure will be appreciated and understood by those skilled in the art from the following detailed description, drawings, and appended claims.

DETAILED DESCRIPTION

Figure 1:
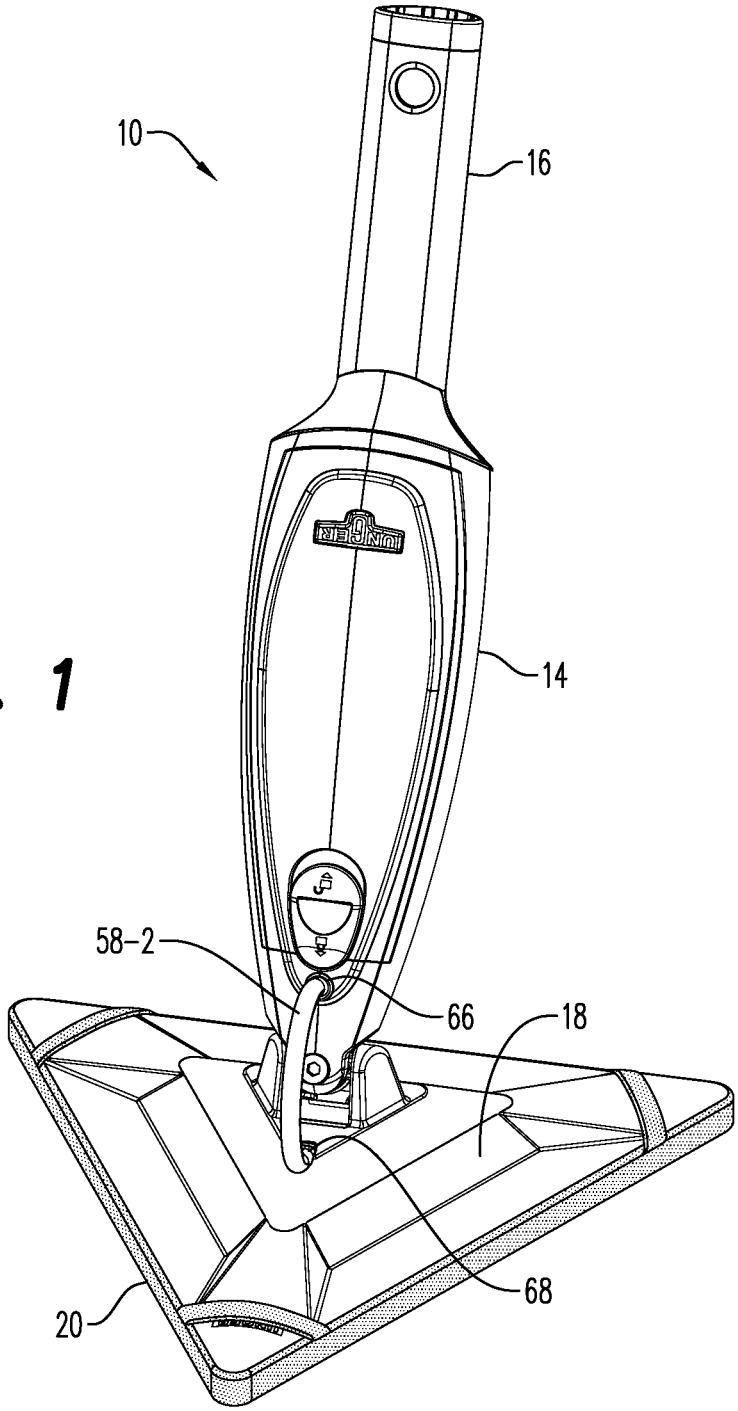
FIG. 1 is a front perspective view of an exemplary embodiment of a cleaning device according to the present disclosure.
Figure 2:
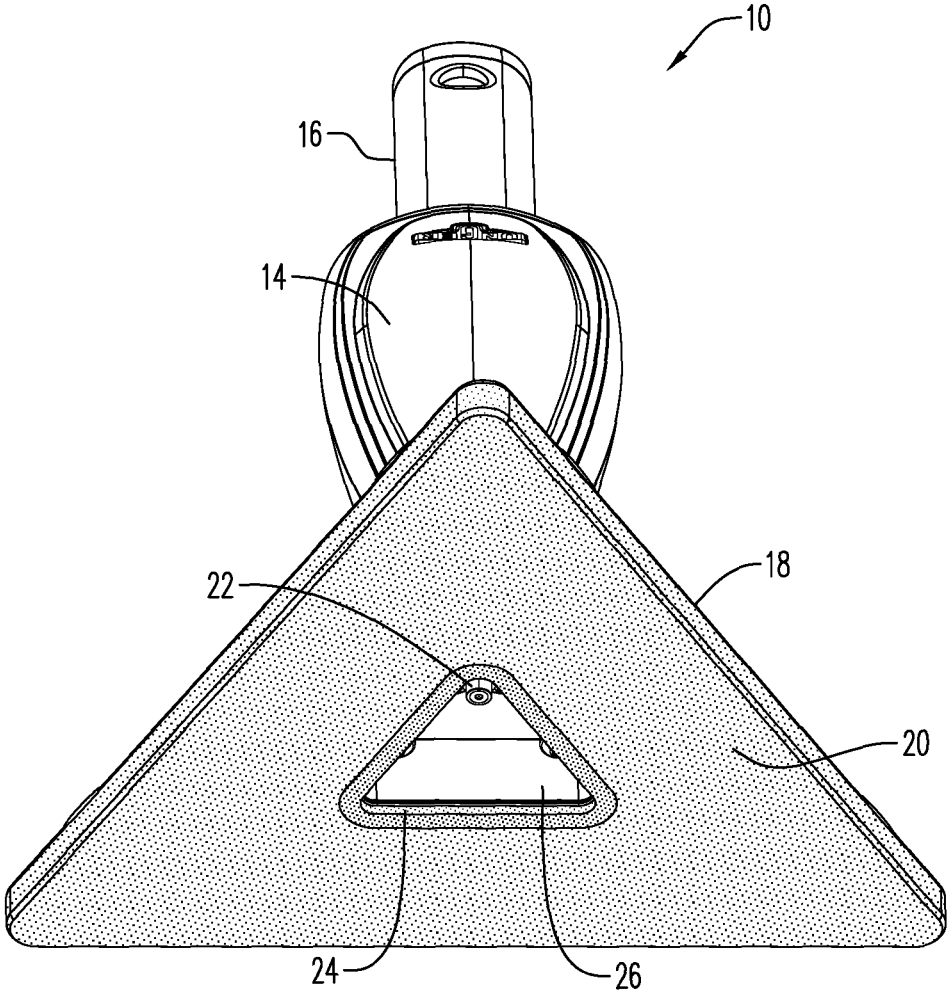
FIG. 2 is a rear perspective view of the cleaning device of FIG. 1.
Figure 3:
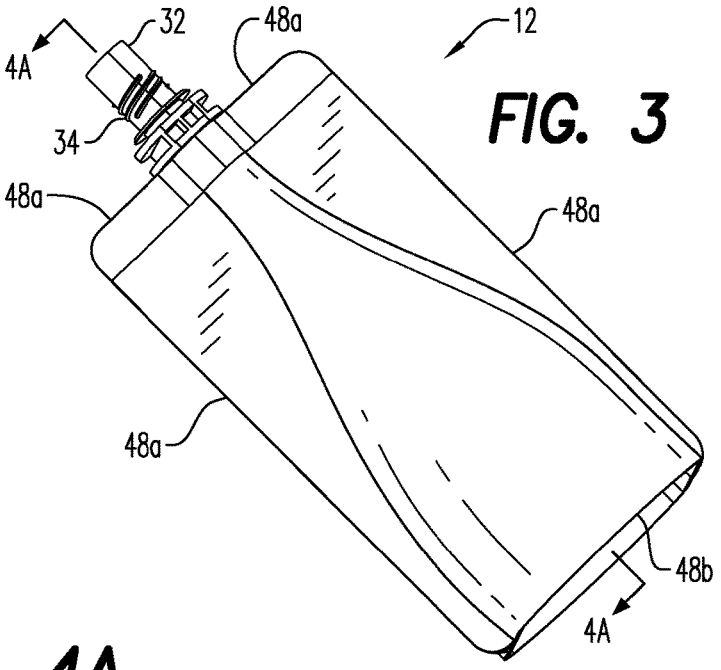
FIG. 3 is a side view of an exemplary embodiment of a cleaning fluid pouch for use with the device of FIG. 1.
Figure 4A:
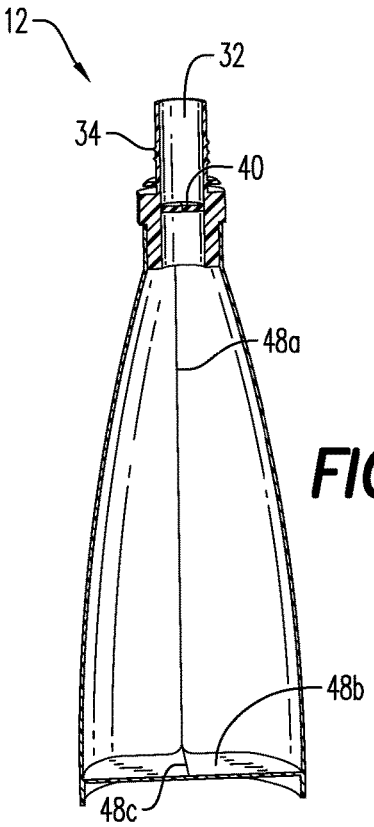
FIG. 4*a* is a section view of the cleaning fluid pouch of FIG. 3 taken along line 4*a*-4*a;*
Figure 4B:
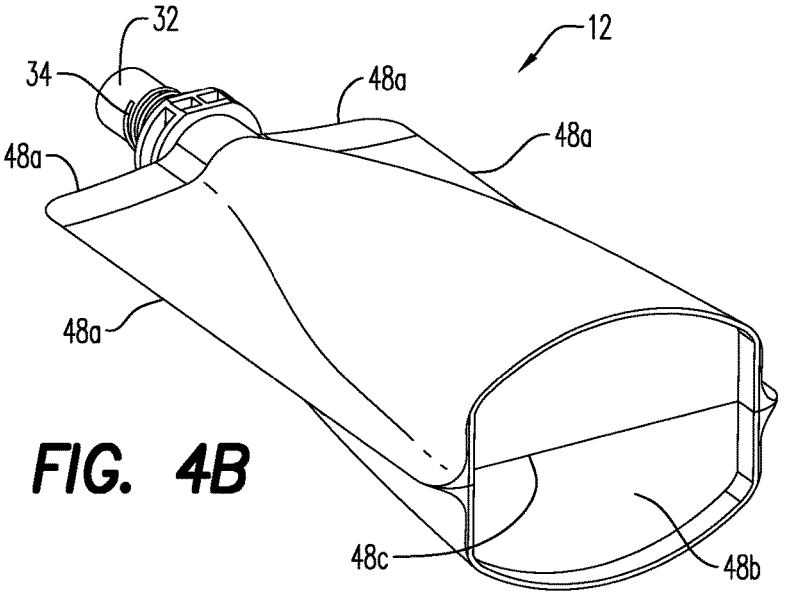
FIG. 4*b* is a bottom view of the cleaning fluid pouch of FIG. 3.
Figure 5:
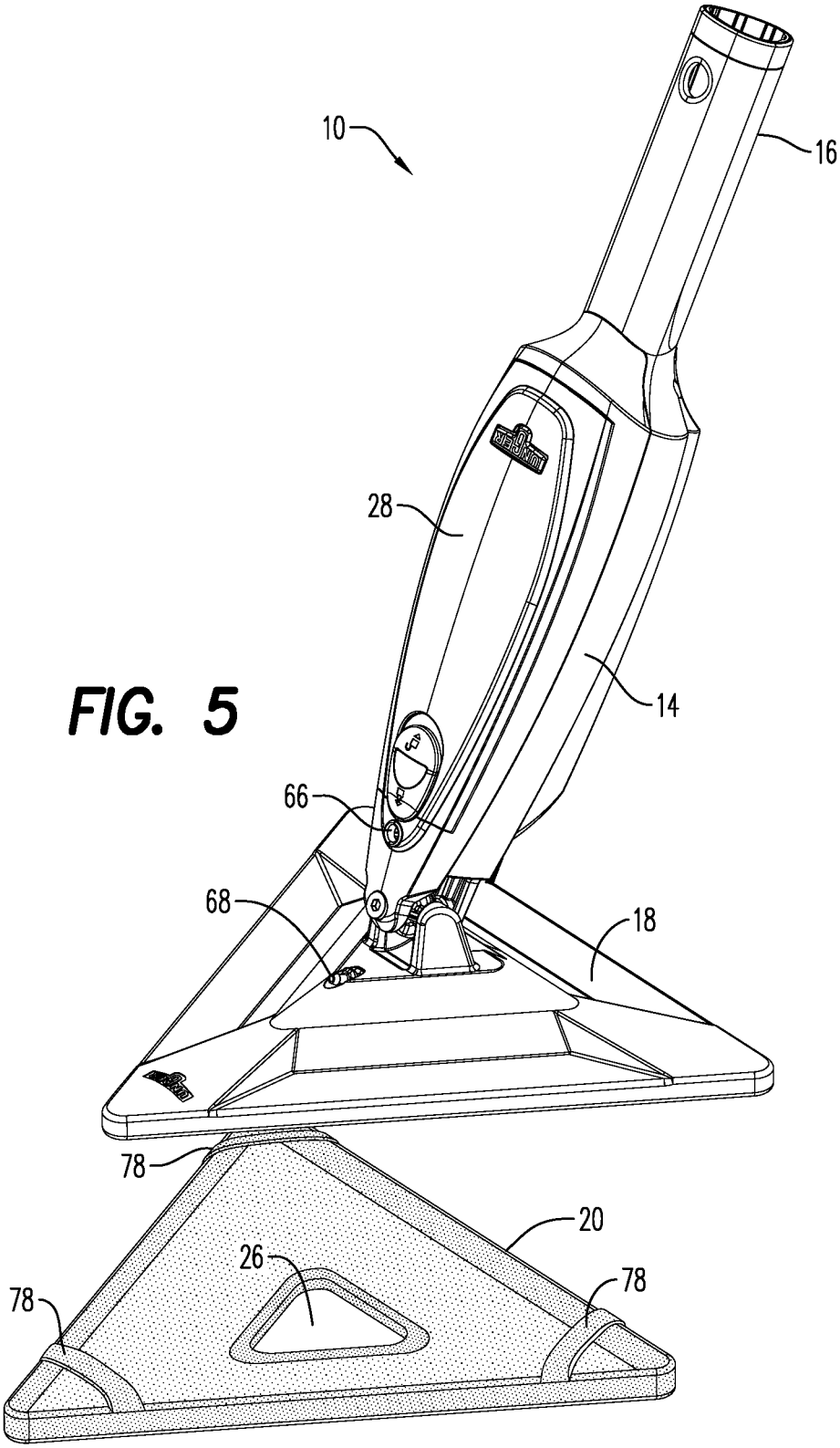
FIG. 5 is another front rear perspective view of the cleaning device of FIG. 1 illustrating the removability of the cleaning element.
Figure 6:
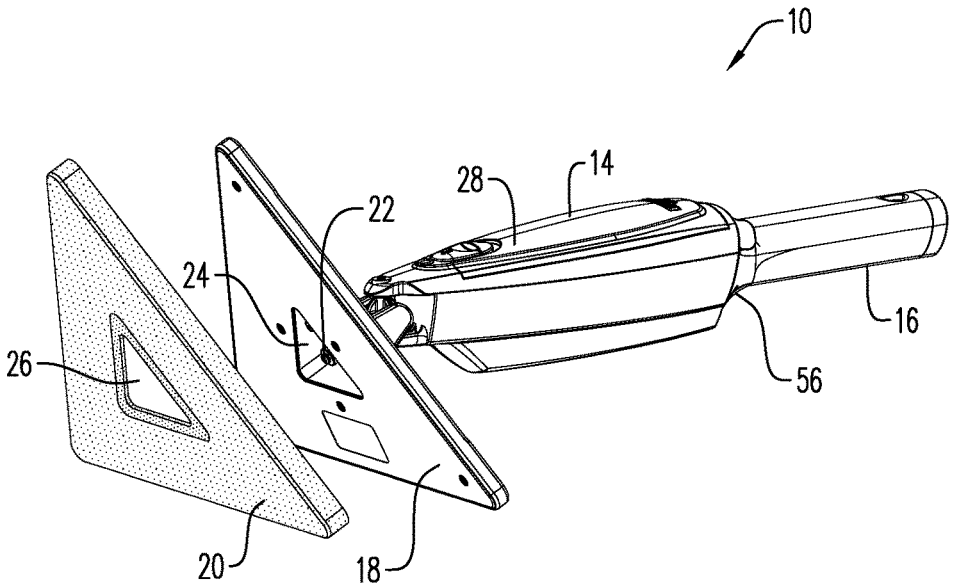
FIG. 6 is a bottom perspective view of the cleaning device of FIG. 1 illustrating the removability of the cleaning element.
Figure 7:
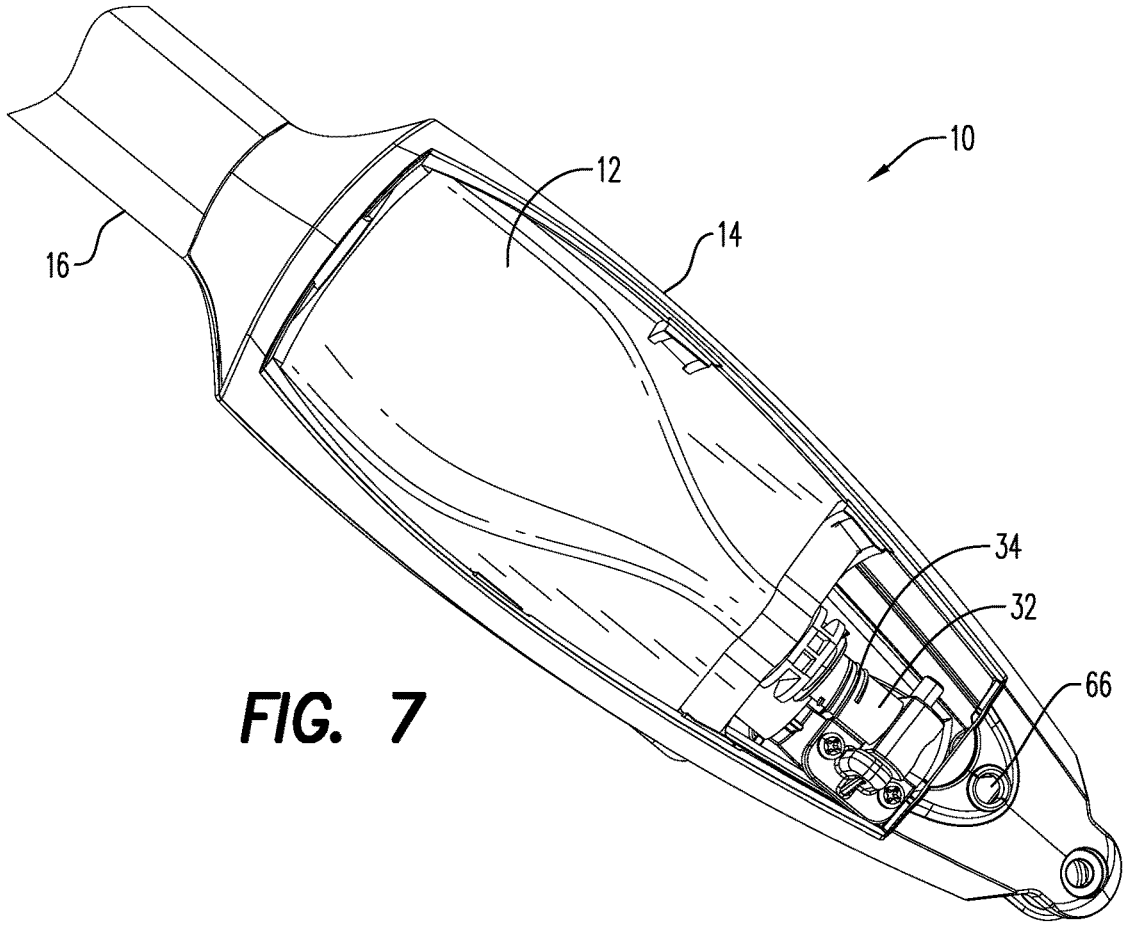
FIG. 7 is a top perspective view of the cleaning device of FIG. 1 having a housing cover removed to illustrate the cleaning pouch installed in an internal cavity.
Figure 8:
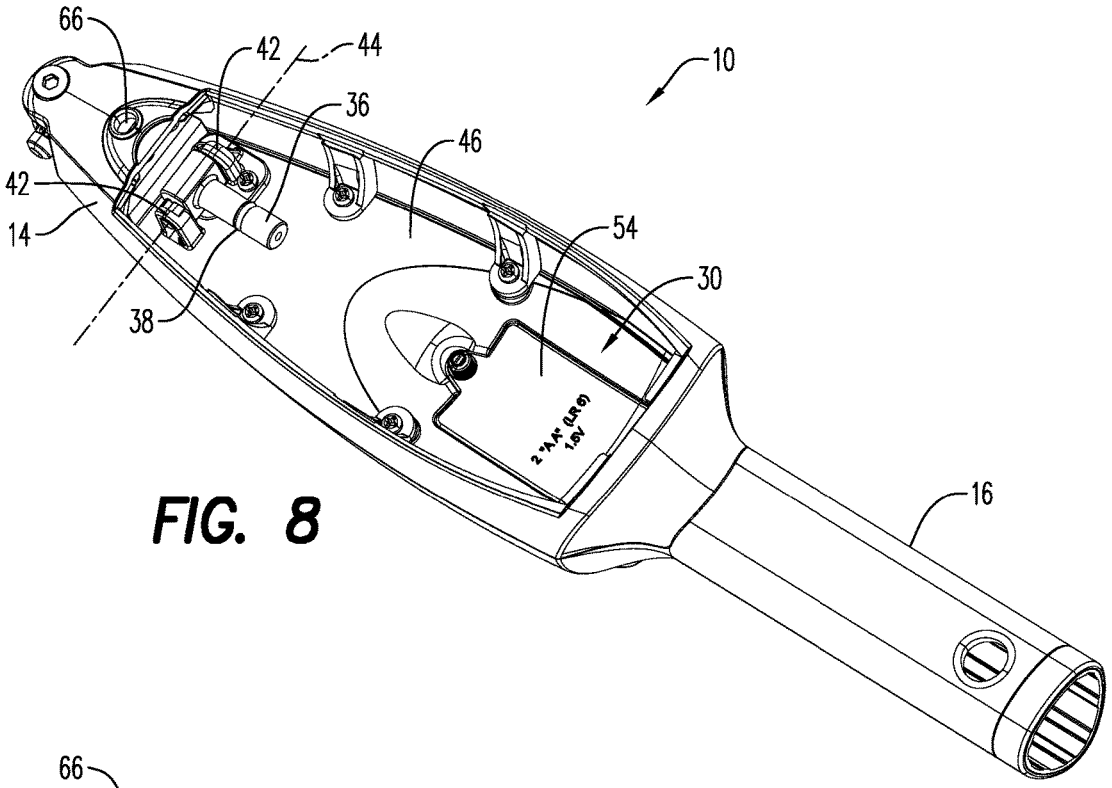
FIG. 8 is a top perspective view of the cleaning device of FIG. 1 having the housing cover and cleaning pouch removed.
Figure 9:
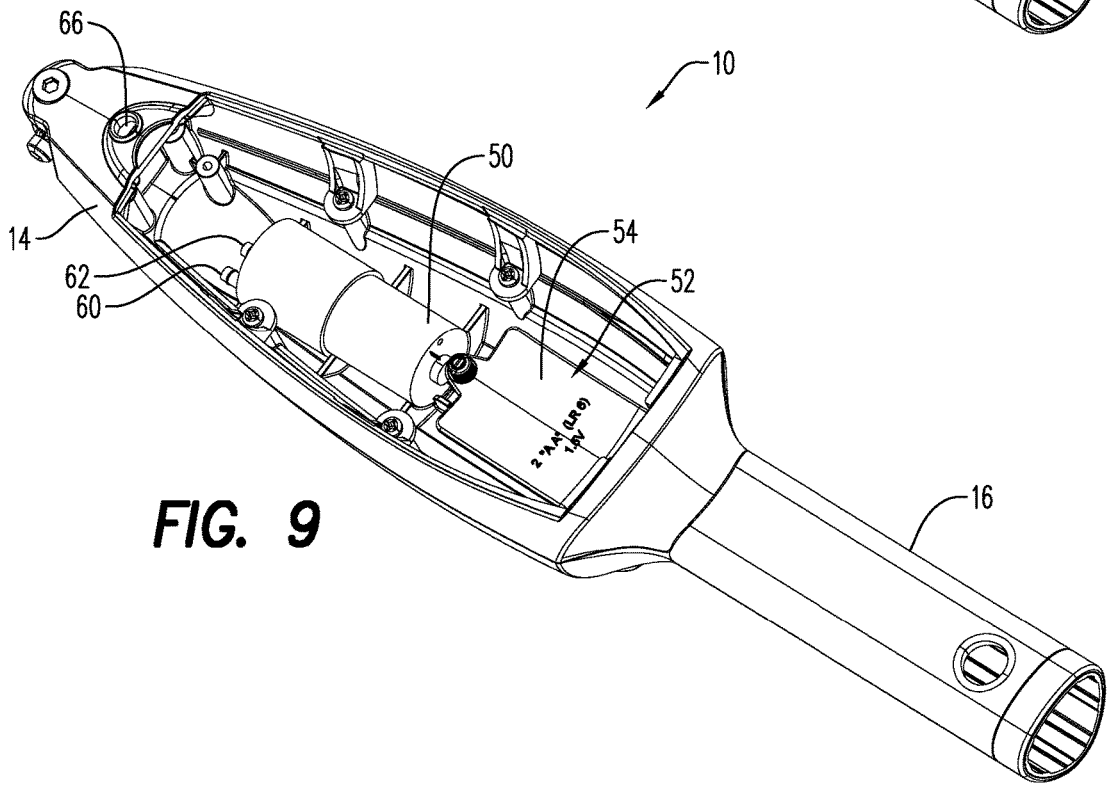
FIG. 9 is a top perspective view of the cleaning device of FIG. 1 illustrating the internal cavity.
Figure 10:
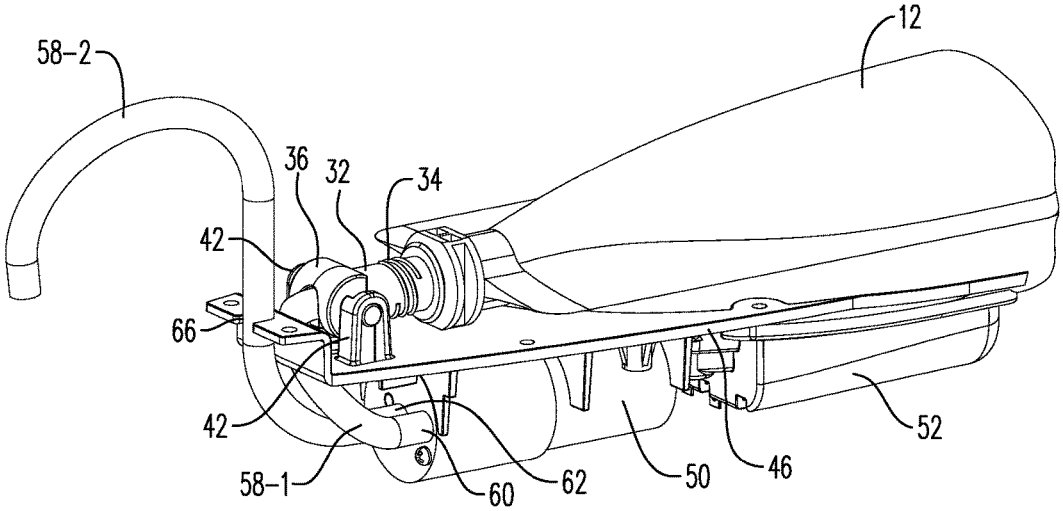
FIG. 10 is a top perspective view of the pump system of FIG. 9.
Figure 11:
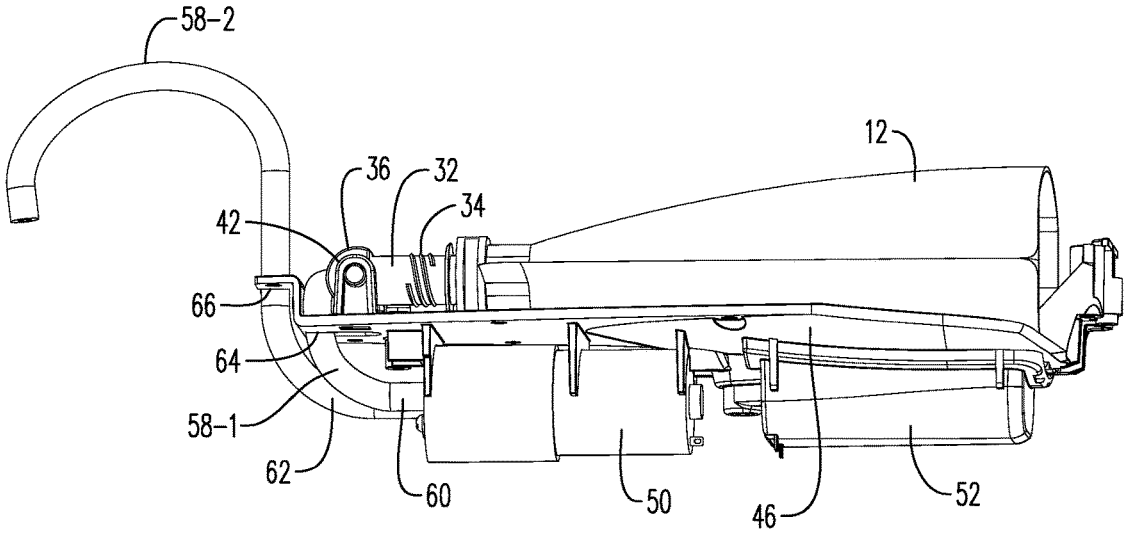
FIG. 11 is a side perspective view of the pump system of FIG. 9.
Figure 12:
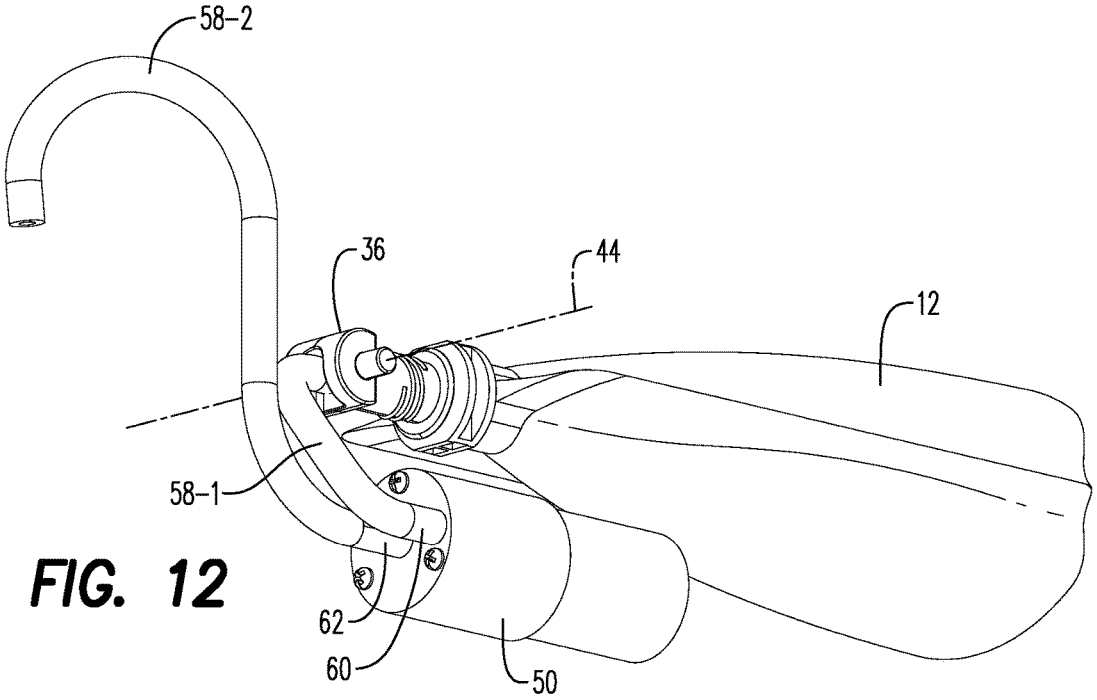
FIG. 12 is a front perspective view of portions of the pump system of FIG. 9.
Figure 13:
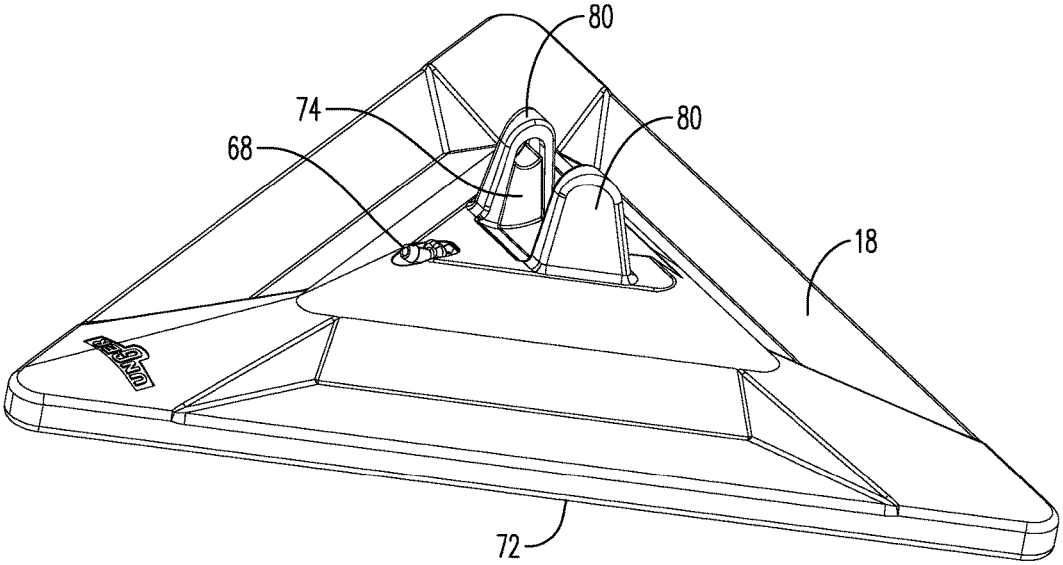
FIG. 13 is a top perspective view of an exemplary embodiment of a cleaning head according to the present disclosure.
Figure 14:
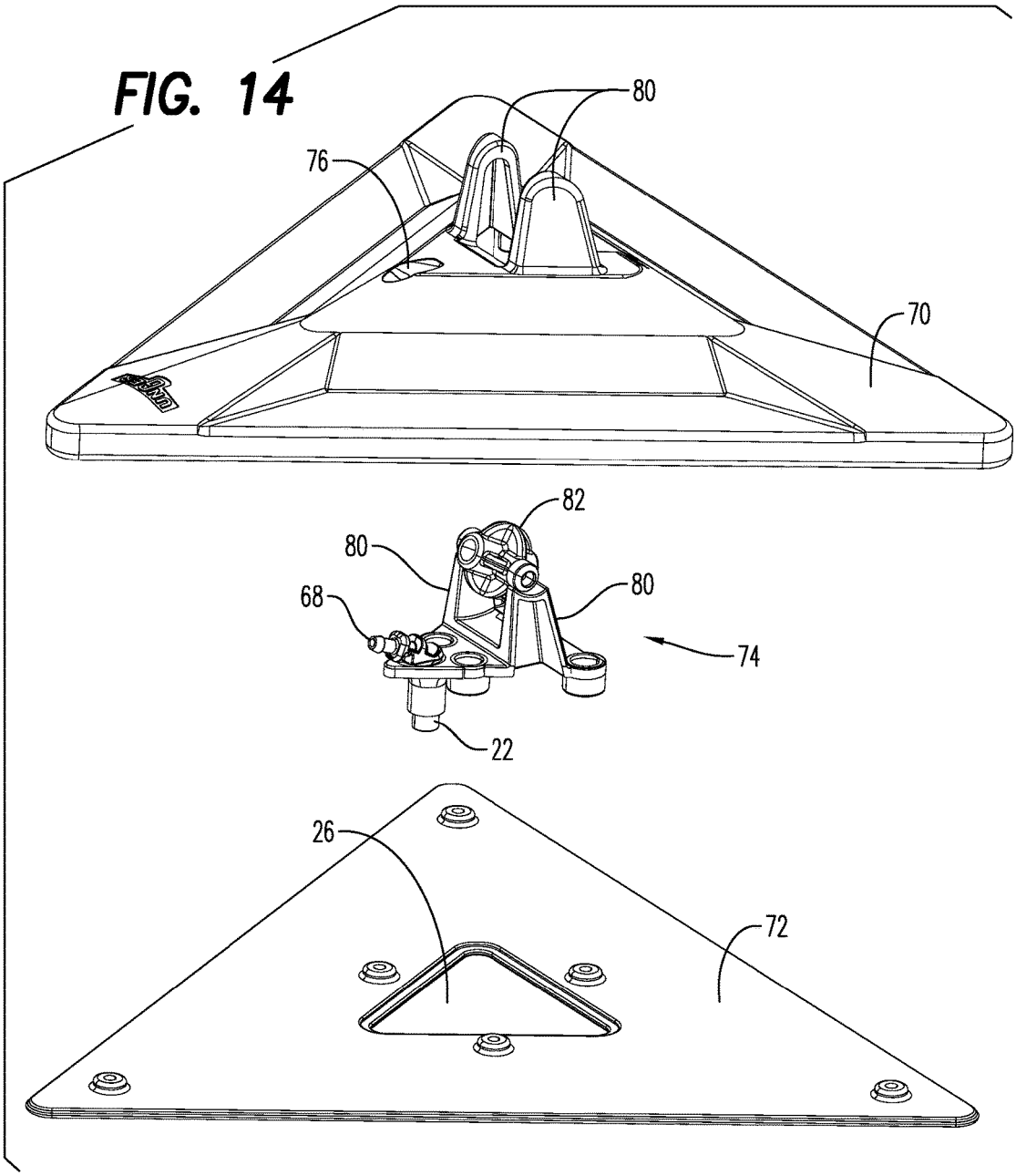
FIG. 14 is a top perspective, exploded view of the cleaning head of FIG. 13.

Referring to the drawings and in particular to FIGS. 1-3, an exemplary embodiment of a cleaning device according to the present disclosure is shown and is generally referred to by reference numeral 10 and an exemplary embodiment of a cleaning fluid pouch according to the present disclosure is shown and is generally referred to by reference numeral 12.

Device 10 includes a main housing 14 having a handle 16 depending therefrom. Device 10 also includes a cleaning head 18 having a cleaning element 20 disposed thereon. As will be described in more detail below, device 10 is configured to removably receive pouch 12 within housing 14.

Additionally, device 10 is configured to pump fluid from pouch 12 to one or more spray nozzles 22 (one shown) directly onto the surface being cleaned. Here, cleaning head 18 and cleaning element 20 each include central openings 24, 26, respectively that are in alignment or registration with one another so that spray nozzles 22 spray the cleaning fluid through the openings 24, 26 onto the surface being cleaned. Thus, nozzles 22 are protected from damage that may occur during use.

Moreover and when device 10 is placed with cleaning element 20 against the surface being cleaned, any spray of the cleaning fluid is captured or trapped within head 18 due to the position of nozzles 22. Without wishing to be bound by any particular theory, it is believed that device 10—by capturing the spray of the cleaning fluid between head 18 and the surface being cleaned—prevents airborne cleaning fluid from being present in the air near the user's mouth and nose, particularly as the device is held at or above head level while cleaning windows, mirrors, and the like. In the example where device 10 is used in window cleaning, the cleaning fluid often includes chemicals with a viscosity low enough to be formed into a mist—namely atomized or formed into an aerosol—by the spraying through nozzles 22. When prior art window cleaning devices are used to clean items at or above the user's mouth and nose, the atomized cleaning fluid can disadvantageously pass through the breathing space—an outcome that device 10 prevents by constraining the spray of the cleaning fluid between head 18 and the surface being cleaned.

Figure 15:
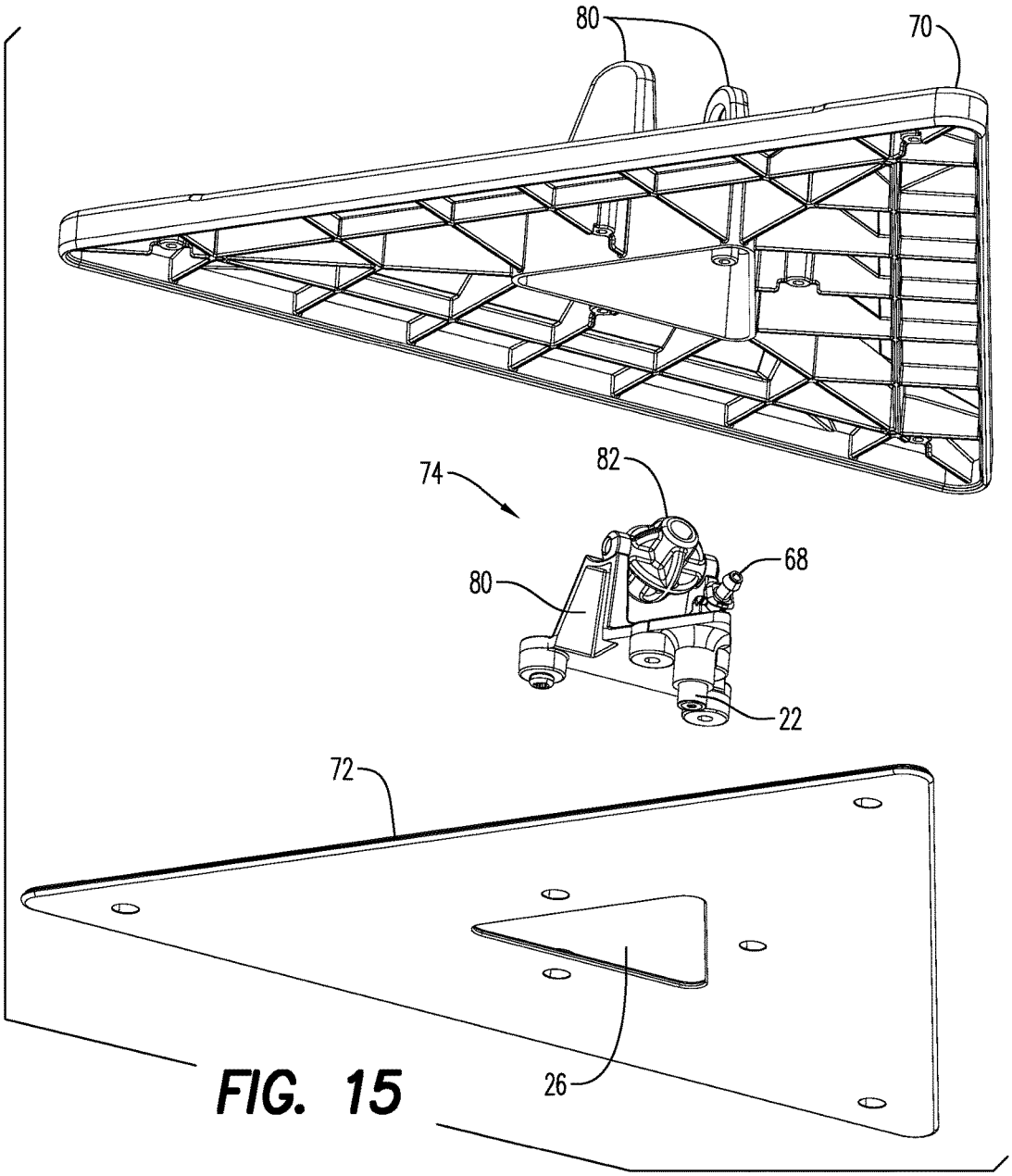
FIG. 15 is a bottom perspective, exploded view of the cleaning head of FIG. 13.
Figure 15A:
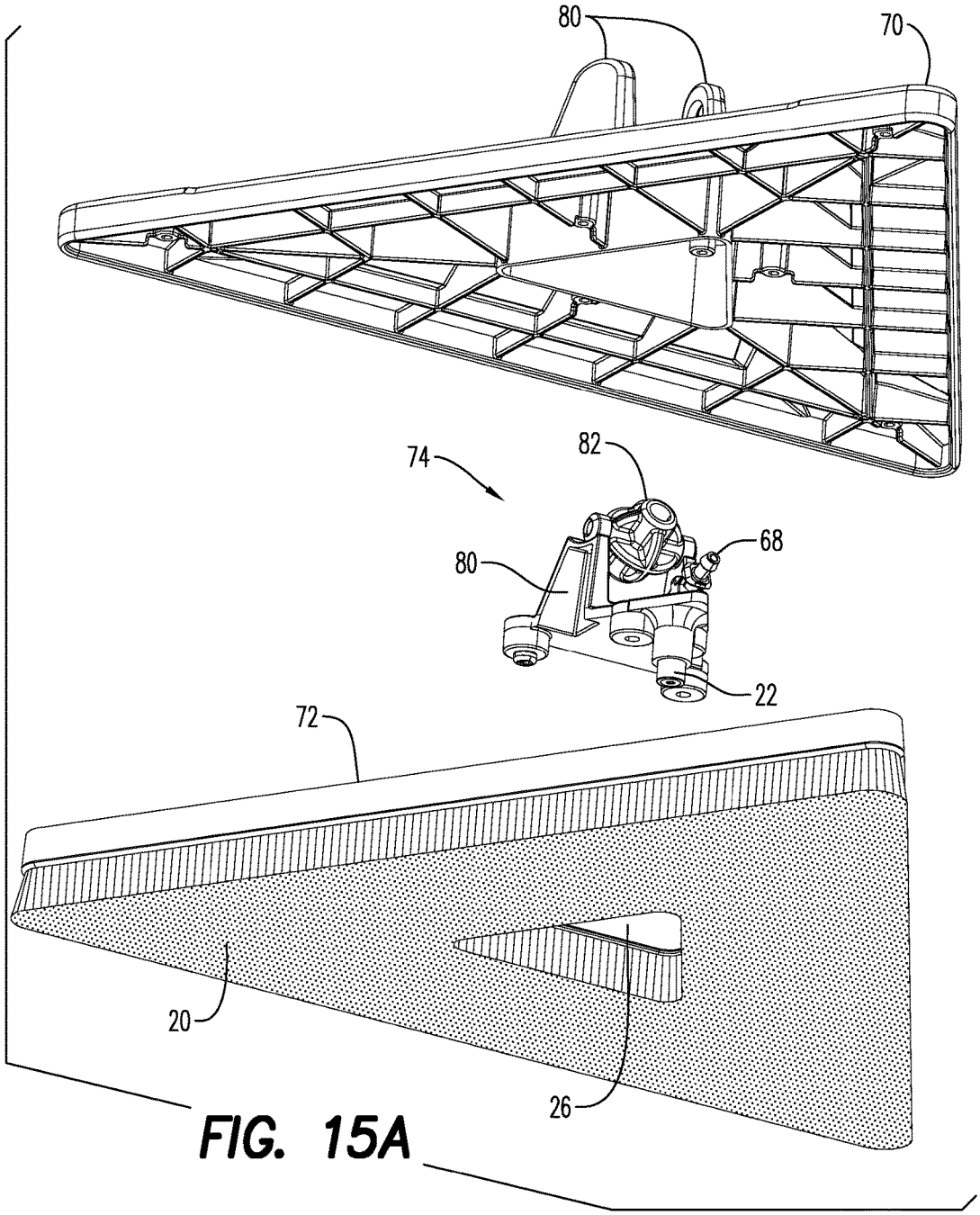
FIG. 15A is a bottom perspective, exploded view of an alternate embodiment of the cleaning head of FIG. 13.

In the embodiment illustrated, cleaning element 20 is illustrated as a cleaning pad made of, for example, microfiber, cotton, wool, non-woven, or any combinations thereof. Of course, it is contemplated by the present disclosure for cleaning element 20 to be any desired element such as, but not limited to, brush bristles as shown in FIG. 15A, squeegee, scraper, or any other cleaning element and combinations thereof.

In this manner, device 10 and pouch 12 increase the ease of use during the cleaning of various hard surfaces by, for example, providing improved ergonomics, location of switches, and/or maneuverability. In some embodiments, device 10 and pouch 12 advantageously provide sufficient weight at cleaning head 18 so as to assist the user in applying cleaning element 20 to the surface being cleaned, which assists the operator to clean the surface.

Device 10 and pouch 12 are described in more detail with simultaneous reference to FIGS. 1-12.

Housing 14 includes a removable cover 28 disposed over an internal cavity 30 so as to allow the user to selectively open and close the cavity. Cavity 30 is configured to removably receive pouch 12 therein. Pouch 12 is formed of a material having sufficient flexibility to conform to the space within cavity 30. For example, pouch 12 is preferably formed of a foil or polymer material.

It should be recognized that pouch 12 is described above by way of example only as a flexible pouch. Of course, it is contemplated by the present disclosure for pouch 12 to form a liner of a fluid container, where the liner collapses within the rigid container during use.

Pouch 12 includes a connection port 32 that allows the pouch to form a releasable fluid and air tight connection with device 10. Connection port 32 includes a closure member 34, illustrated as an external thread, which removably receives a cap or closure (not shown) to close the pouch before use and/or between uses. In this manner, pouch 12 is easily accessible and replaceable.

Device 10 includes a pouch port 36 that can be removably received in connection port 32 of pouch 12 to place the pouch in fluid communication with the inlet port. Thus, a user can remove the cap from closure member 34 of pouch 12 and insert pouch port 36 into connection port 32 to form a fluid and air tight connection. In some embodiments inlet port 36 can include an o-ring 38 or other seal member to improve or enhance the seal between pouch 12 and pouch port 36.

Preferably, pouch 12 can include a slit valve 40 that selectively opens upon application of a negative pressure on the pouch by the pump within device 10 and closes, under its own resilience after the pump is turned off. In this manner, device 10 with pouch 12 installed therein forms a fluid tight connection that prevents, or at least minimizes, leakage of cleaning fluid from pouch when the device is stored or not in use and/or when the pouch is removed from the device. Thus, pouch 12 and pouch port 36 are configured so that the pouch port, when inserted into the pouch, does not pass through valve 40.

In the illustrated embodiment, pouch port 36 is secured to housing 14 by one or more upstanding arms 42 so as to pivot about an axis 44. It has been found by the present disclosure that pivoting of pouch port 36 upward out of cavity 30 can assist the user to connect and disconnect pouch 12 to and from housing 14. Specifically, the user can pivot pouch port 36 to face out of cavity 30 during connection of pouch 12, then once connected, can pivot the pouch port back into the cavity to assist in storing the pouch in the cavity.

Pouch 12 can be held in position in cavity 30 by—for example—the friction between connection and pouch ports 32, 36. Of course, it is contemplated by the present disclosure for device 10 to secure pouch 12 in cavity 30 by any desired method.

Cavity 30 includes a plate 46 that separates pouch 12 from one or more electrical components—namely pump 50 and power source 52 such as a battery. In order to allow replacement of the power source 52, plate 46 can include a separate removable cover 54, which in some embodiments can be provided with a seal or o-ring (not shown) to eliminate or at least mitigate leakage of fluids into the power source.

Pump 50 and power source 52 are in selective electrical communication with one another by way of an activation button 56 defined on housing 14. In this manner, the user can—by depressing button 56—place pump 50 in electrical communication with power source 52 to selectively activate the pump.

In some embodiments, device 10 is configured in a manner that minimizes hydraulic resistance so that that size and weight of pump 50 and power source 52 can be minimized. The hydraulic resistance of device 10 can be minimized by, for example, allowing pouch 12 to collapse as pump 50 draws fluid from the pouch. Stated another way, the fluid and air tight connection between connection and pouch ports 32, 36 results in pouch 12 collapsing as fluid is withdrawn from the pouch.

It should be recognized that device 10 is described by way of example as including pump 50 described in combination with power source 52 as an electric pump. Of course, it is contemplated by the present disclosure for device 10 to find use with a manual pump—that allows the operator to actuate the manual pump via actuation button 56 in the form of a trigger or similar device.

Pouch 12 includes, in some embodiments, an elongated sealed edge 48*a* along the elongated sides and top and a flat bottom 48*b*. In this manner, pouch 12 returns to a substantially flat shape when collapsing as the fluid is withdrawn with flat bottom 48*b* being pulled into pouch 12 along one or more pleats or folds 48*c*. Without wishing to be bound by any particular theory, it is believed that the easy to collapse configuration of pouch 12 assists in providing the minimized hydraulic resistance of device 10.

Additionally, the hydraulic resistance of device 10 can also be minimized by, for example, reducing the number of valves in the fluid path—which is also made possible, at least in part, by the fluid and air tight connection between connection and pouch ports 32, 36. Thus, device 10 has only one valve, namely valve 40, in the fluid path yet still provides a system that eliminates, or at least minimizes, leakage of cleaning fluid from pouch 12 when the device is stored or not in use. Accordingly, device 10, in some embodiments, is configured so that pump 50 is a 3 volt pump and power source 52 is two standard AA batteries.

Pump 50 includes a pump inlet 60 and a pump outlet 62. Device 10 includes a conduit path 58-1 fluidly connecting pump inlet 60 to pouch port 36. Conduit 58-1 between pouch port 36 and pump inlet 60 passes through plate 46 at a first pathway 64.

Device 10 also includes conduit path 58-2 fluidly connecting pump outlet 62 to spray nozzles 22. Conduit path 58-2 between pump outlet 62 passes through plate 46 at a second pathway 66. Specifically, head 12 includes a head inlet 68 to which conduit path 58-2 from pump outlet 62 is fluidly connected.

Head 18 is described in more detail below with respect to FIGS. 13-16, which also provides more detail on the fluid connection between head inlet 68 and spray nozzles 22.

Head 18 includes an upper cover 70, a lower cover 72, and a support member 74 positioned between the covers. Support member 74 includes spray nozzles 22 and head inlet 68 fluidly communicating with one another. Upper cover 70 includes a port 76 through which head inlet 68 extends. Similarly, lower cover 72 includes central opening 26 through which spray nozzles 22 are directed. Preferably, support member 74 is configured so that nozzles 22 are recessed with respect to the bottom surface of head 18, which allows the head to prevent the nozzles from being damaged during use.

It should be recognized that device 10 is disclosed by way of example only having central opening 26 in lower cover 72 and having nozzles 22 recessed therein. Of course, it is contemplated by the present disclosure for lower cover 72 to have one or more openings 26 through which nozzles 22 are positioned in a manner to be substantial even or flush with the bottom surface of the lower cover. Moreover, it is contemplated by the present disclosure for lower cover 72 to have one or more openings 26 through which nozzles 22 are positioned to extend from the bottom surface of the lower cover less by a distance less than a thickness of the cleaning element 20. In these embodiments, the thickness of cleaning element 20 provides an offset between nozzles 22 and the surface being cleaned.

Support member 74 and upper cover 70 together form a pair of supports 80, which receive a pivot member 82 therebetween to allow head 18 to be secured to housing 14—and preferably removably secured to the housing. Pivot member 82 is secured between support member 74 and upper cover 70 so as to pivot or rotate about a first axis 84.

Cleaning element 20 can be removably secured to cleaning head 18 in any desired manner. In some embodiments, cleaning element 20 can include one or more connectors 78 for removably securing the cleaning element to head 18. For example, cleaning element 20 is illustrated having three connectors 78 one at each corner of the triangular shape of head 18. In some embodiments, one or more of connectors 78 can be elastic so as to allow cleaning element 20 to be secured to head 18. In other embodiments, one or more of connectors 78 can be hook-and-loop type fasteners so as to allow cleaning element 20 to be secured to head 18. Of course, it is contemplated by the present disclosure for connectors 78 to have any desired configuration sufficient to removably secure cleaning element 20 to cleaning head 18.

Figure 16:
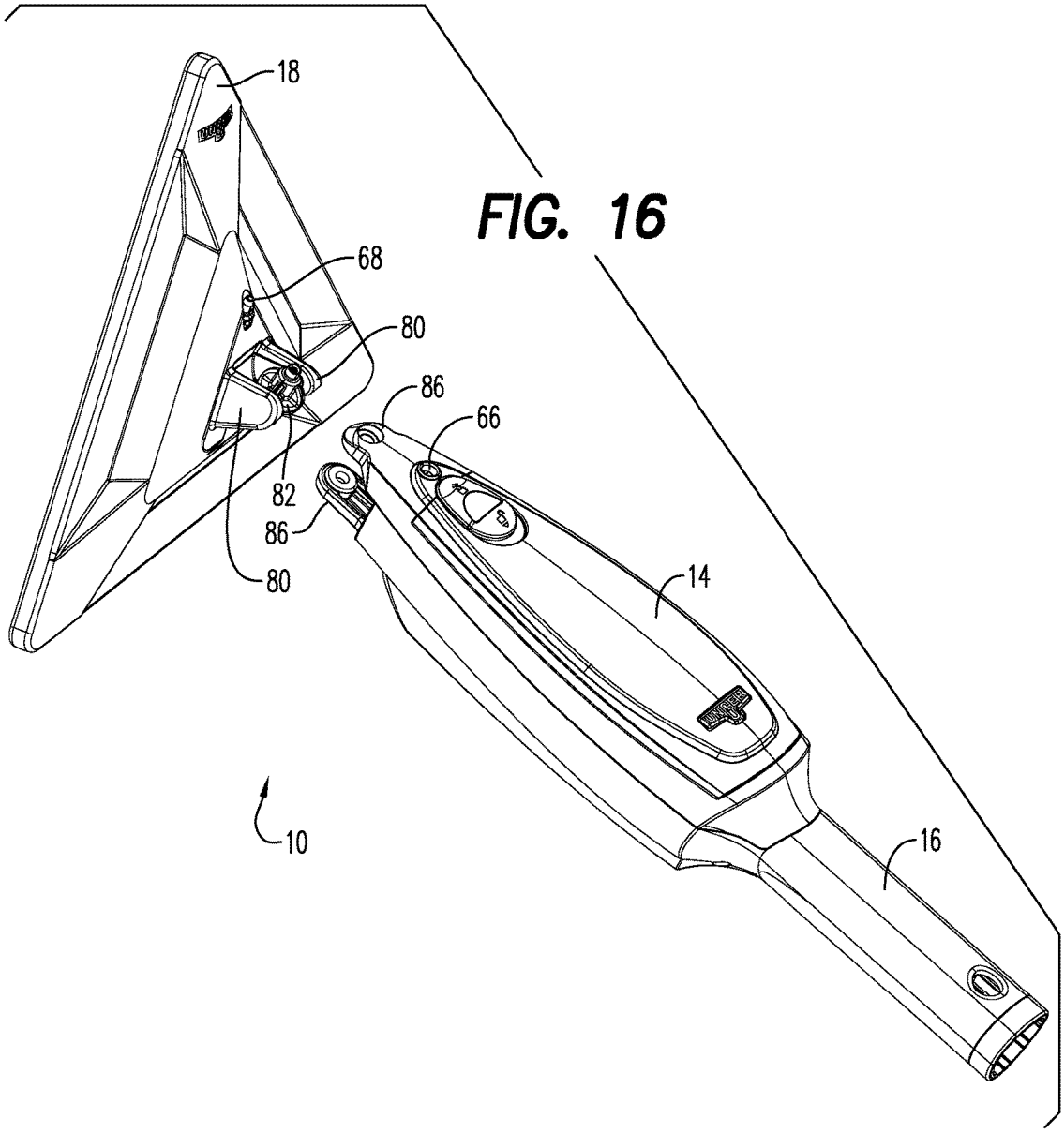
FIG. 16 is a top perspective view of the cleaning device of FIG. 1 having the cleaning head shown in a removed position.
Figure 17:
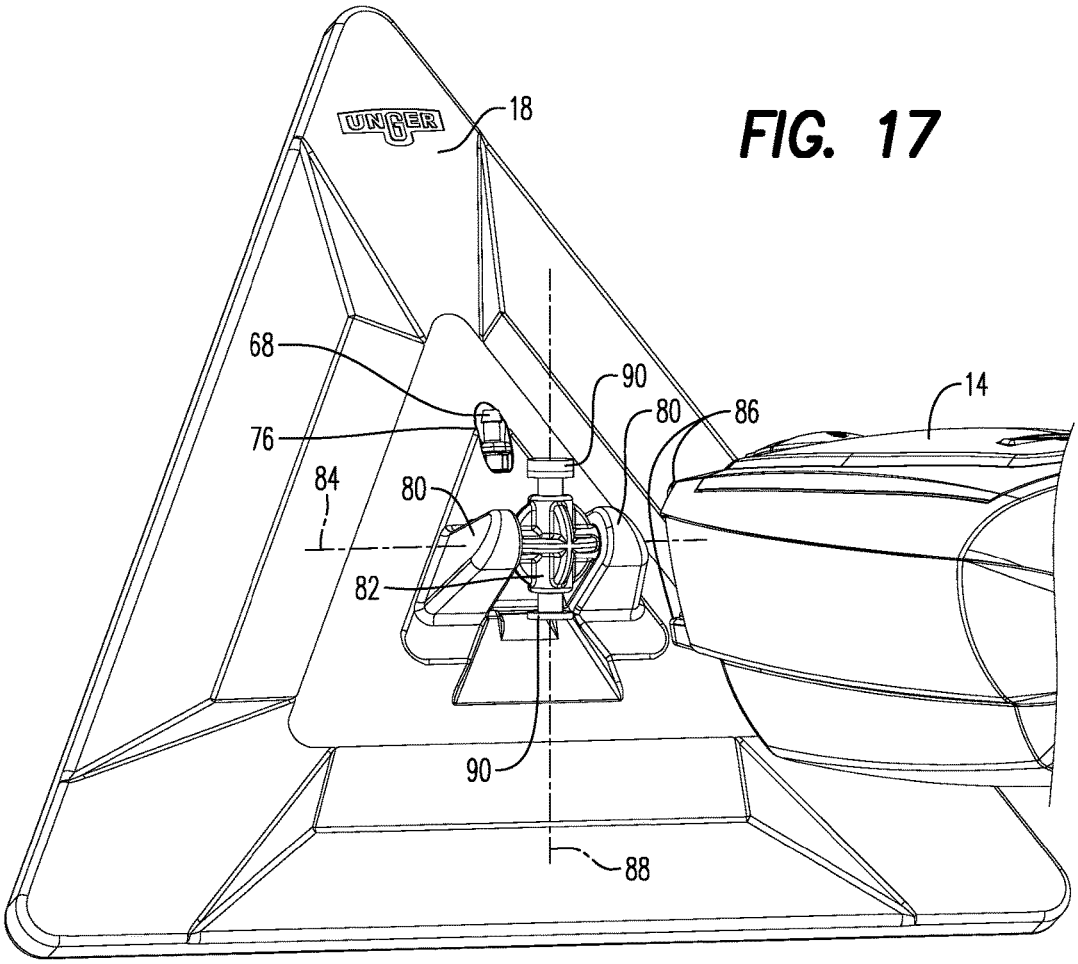
FIG. 17 is an enlarged view of the cleaning device of FIG. 16 having the cleaning head shown in the removed position.
Figure 18:
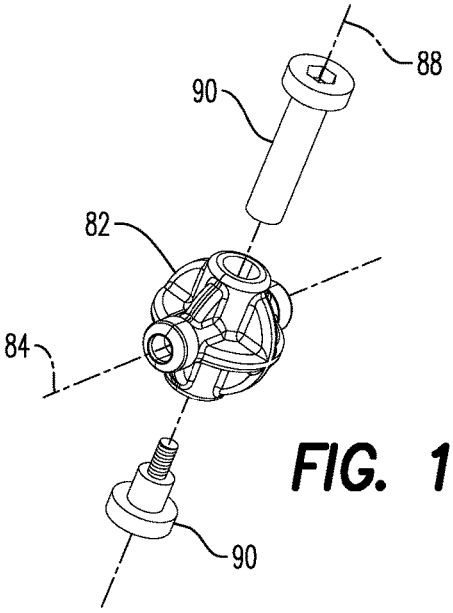
FIG. 18 is an enlarged, exploded view of a pivot member shown in FIG. 16.

The interconnection of housing 16 and head 18 are described in more detail with reference to FIGS. 16-18. Here, housing 16 includes a pair of arms 86 depending therefrom. Pivot member 82 is secured to arms 86 so as to pivot or rotate about a second axis 88 by a connector 90. In this manner, device 10 is configured for rotation about first axis 84 by 160 degrees and about second axis 86 by 180 degrees.

Head 18 can be removed from pivot member 82 and, thus from device 10, by removing connector 90 from the pivot member. In this manner, device 10 is configured to allow the user to replace head 18 or to use heads having different shapes, sizes, and/or configurations. In the illustrated embodiment, connector 90 is shown as a shoulder bolt, which is believed to provide increased structural rigidity to pivot member 82.

Of course, it is also contemplated by the present disclosure for head 18 itself to be configured to allow the user to replace portions of the head with portions having different configurations such as shown in FIG. 15A. Here, lower cover 72 is illustrated being removably received on upper cover 70. Thus in this embodiment, the user can replace one lower cover 72—such as that of FIG. 15 that receives a cleaning cloth as cleaning element 20—with a different lower cover 72—such as that of FIG. 15A that includes a different cleaning element 20, namely brush bristles.

Additionally, it is contemplated by the present disclosure for device 10 to include a scrubbing area such as that disclosed in Applicant's commonly owned U.S. Pat. No. 7,779,501 and/or to include feedback between the different cleaning states as disclosed in Applicant's commonly owned U.S. application Ser. No. 14/668,535, the entire contents of which are incorporated by reference herein.

Figure 19:
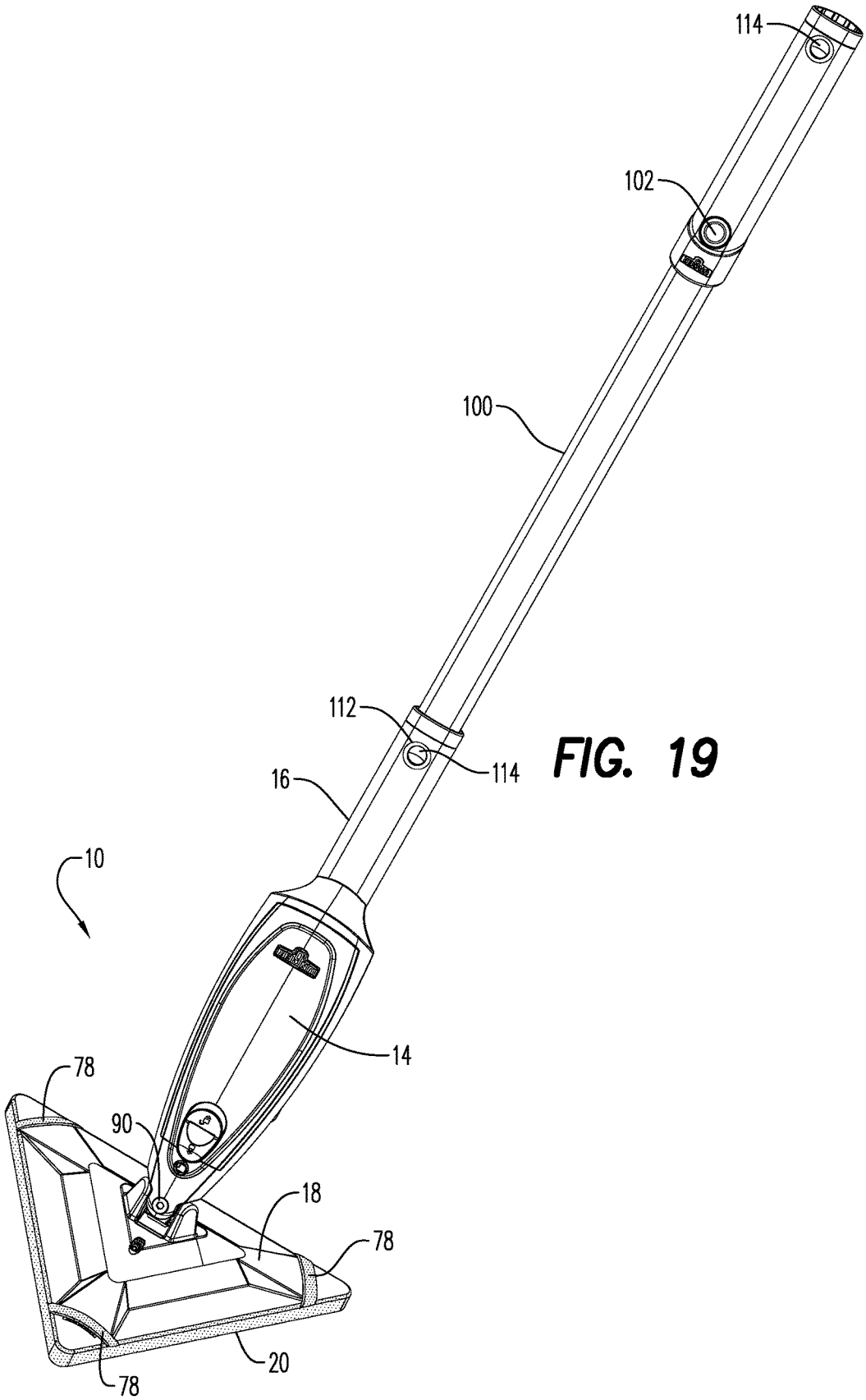
FIG. 19 is a top perspective view of the cleaning device of FIG. 1 having a first extension pole secured thereto.
Figure 20:
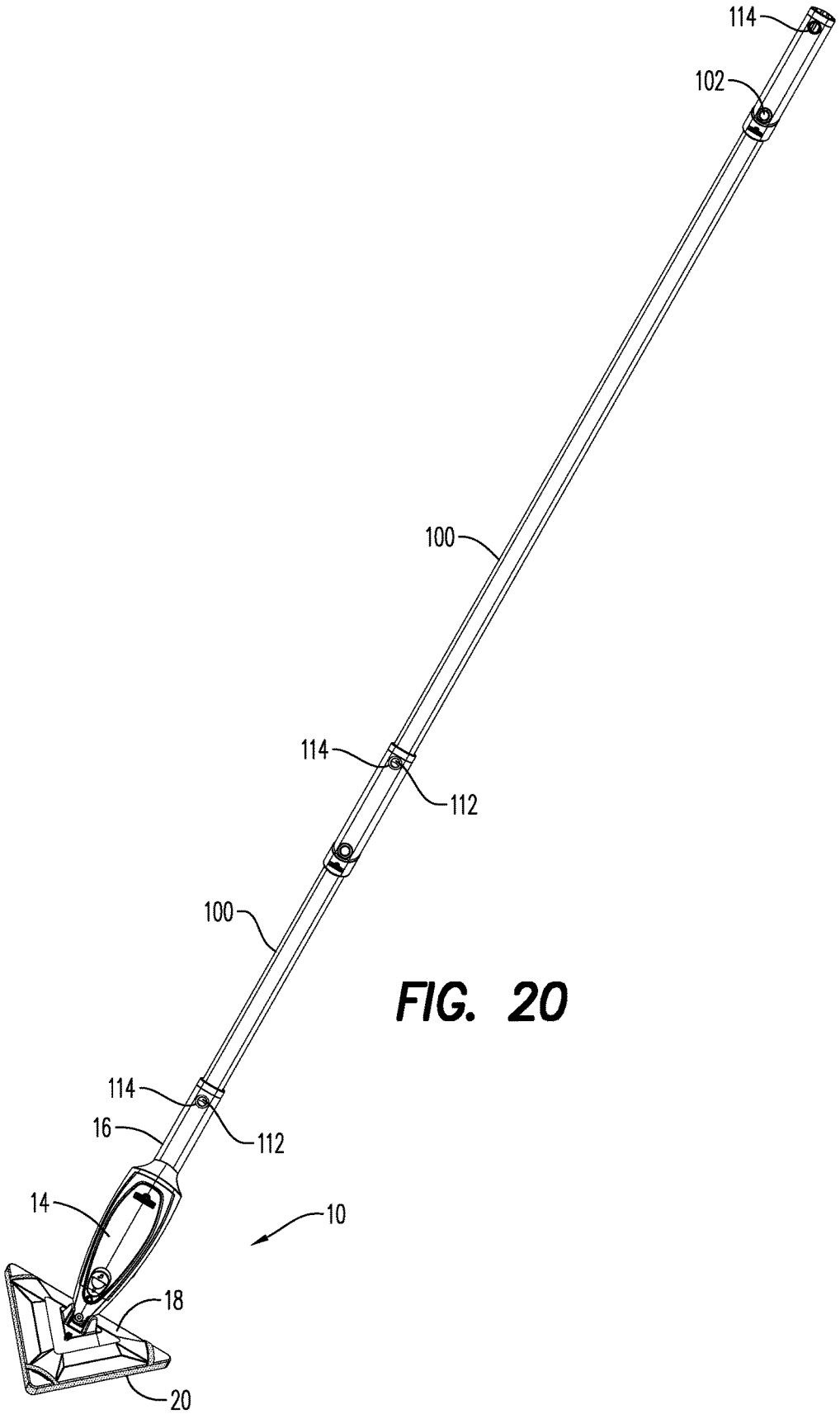
FIG. 20 is a top perspective view of the cleaning device of FIG. 1 having a first extension pole and a second extension pole secured thereto.
Figure 21:
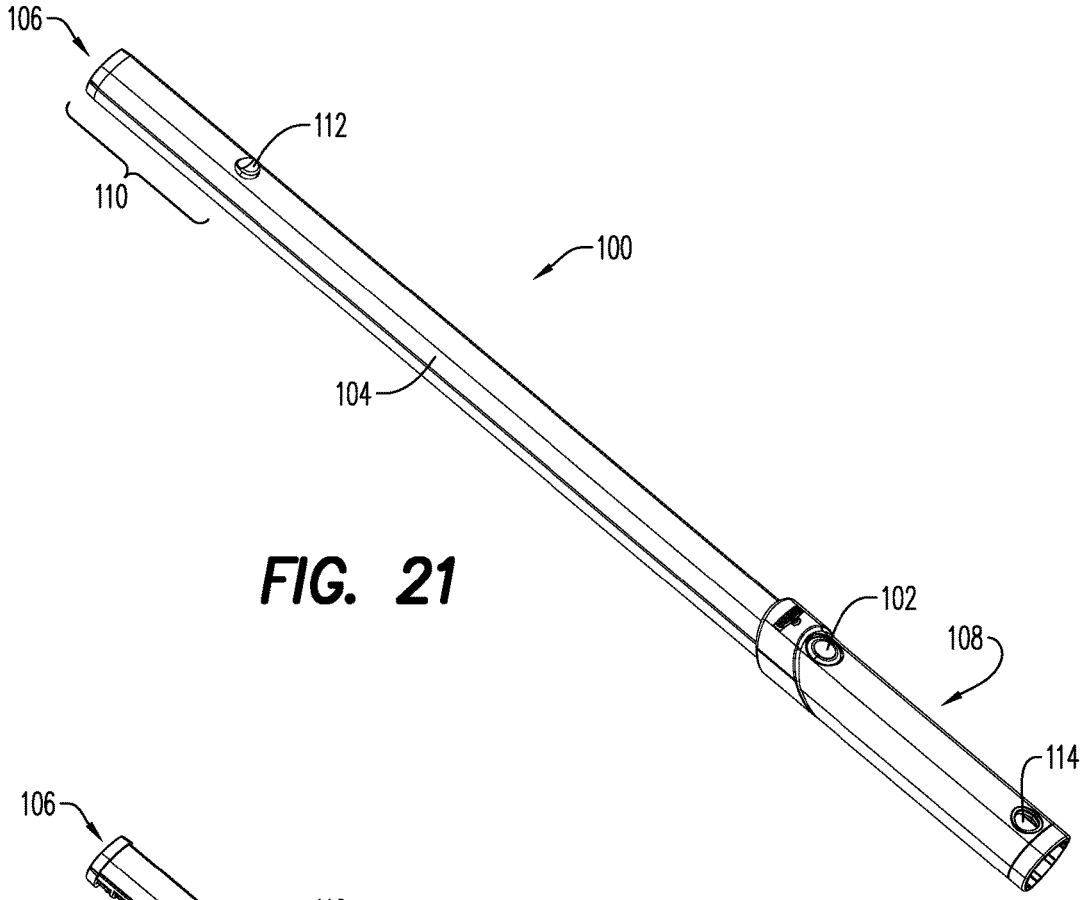
FIG. 21 is a top perspective view of an exemplary embodiment of an extension pole according to the present disclosure.
Figure 22:
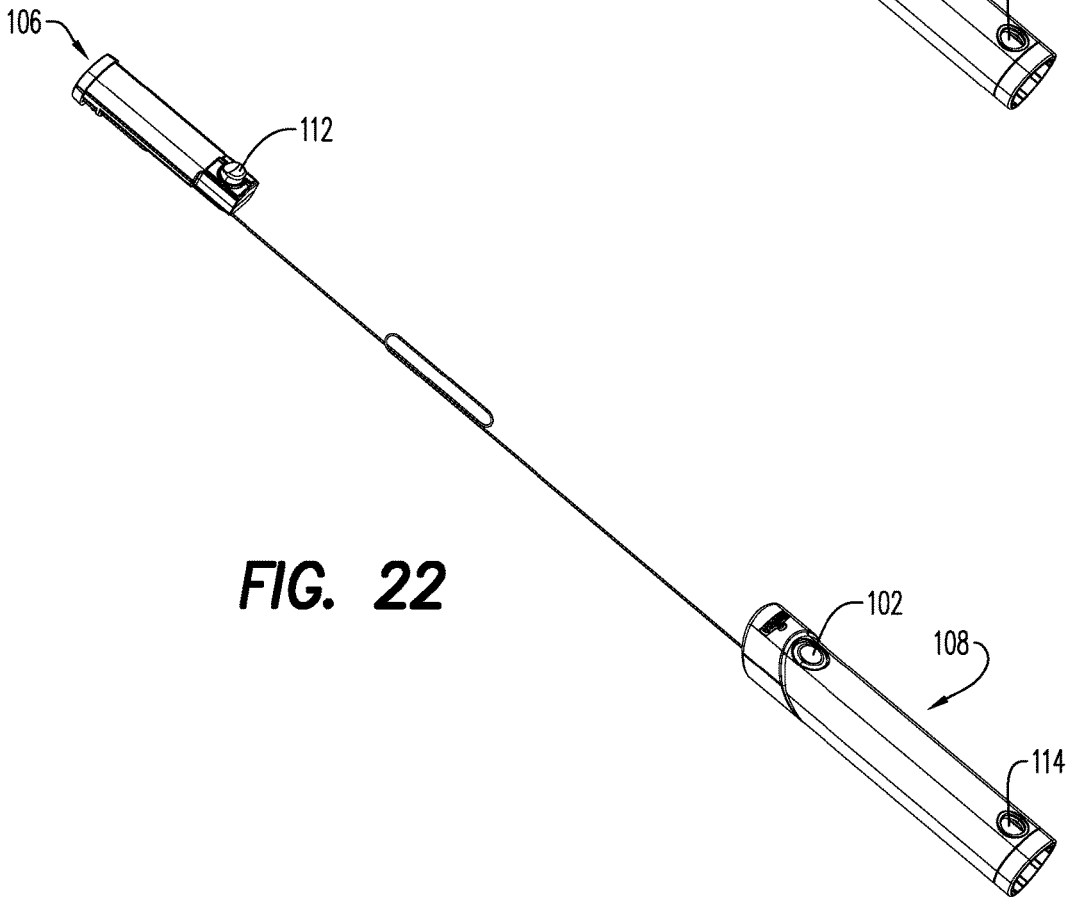
FIG. 22 is a top perspective view of the extension pole of FIG. 21 having various components omitted for clarity.
Figure 23:
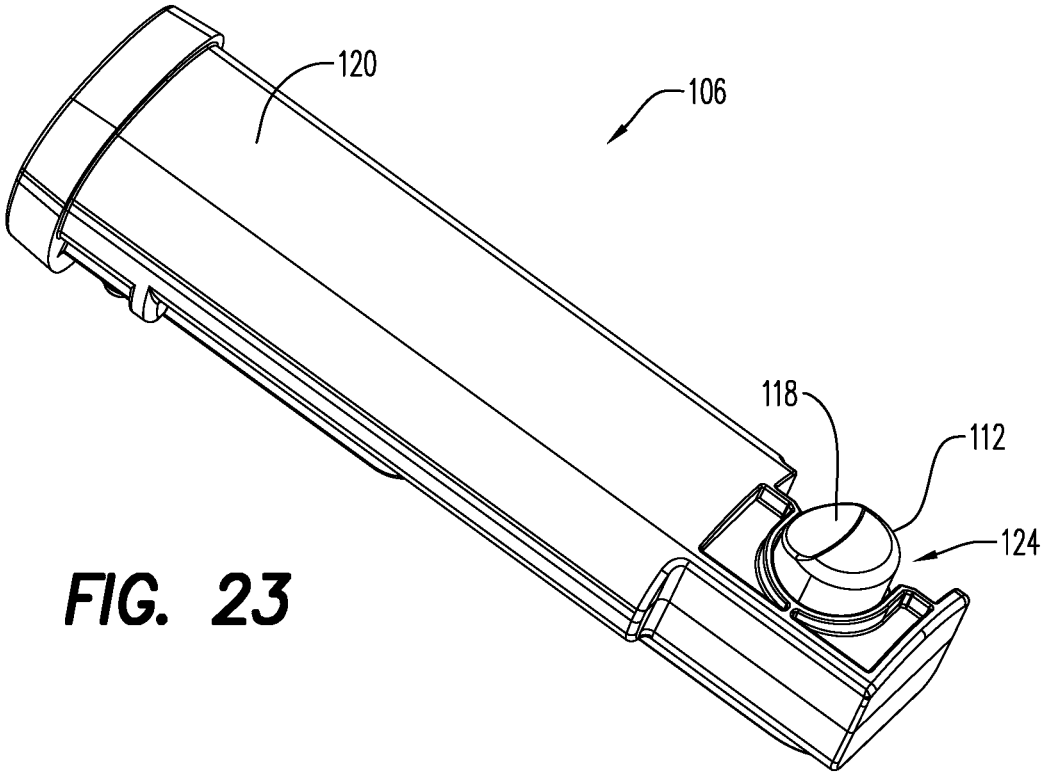
FIG. 23 is a top perspective view of an exemplary embodiment of a first pole connection assembly according to the present disclosure.
Figure 24:
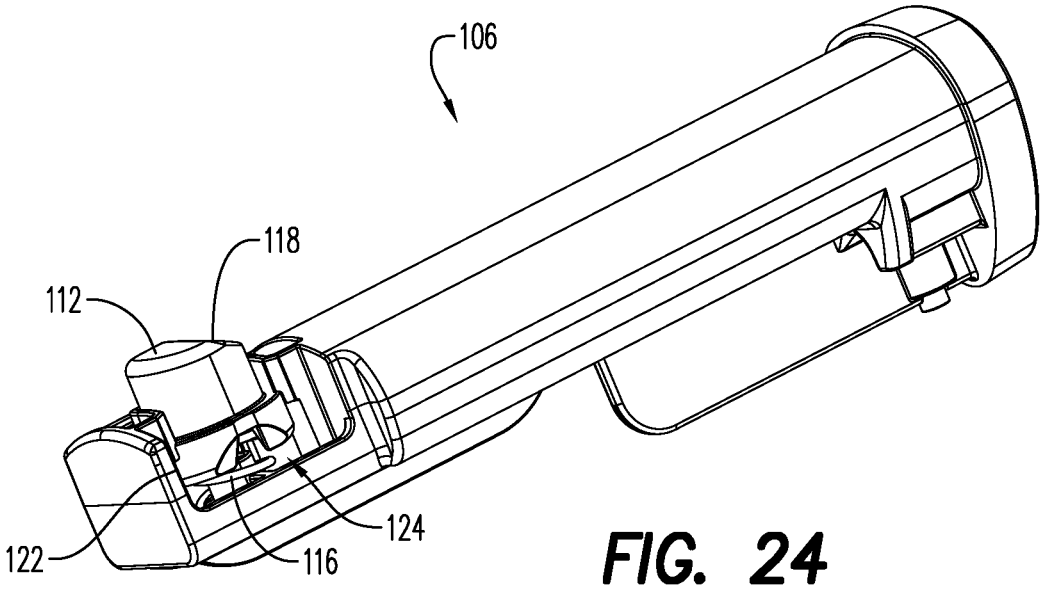
FIG. 24 is a side perspective view of the first pole connection assembly of FIG. 23.
Figure 25:
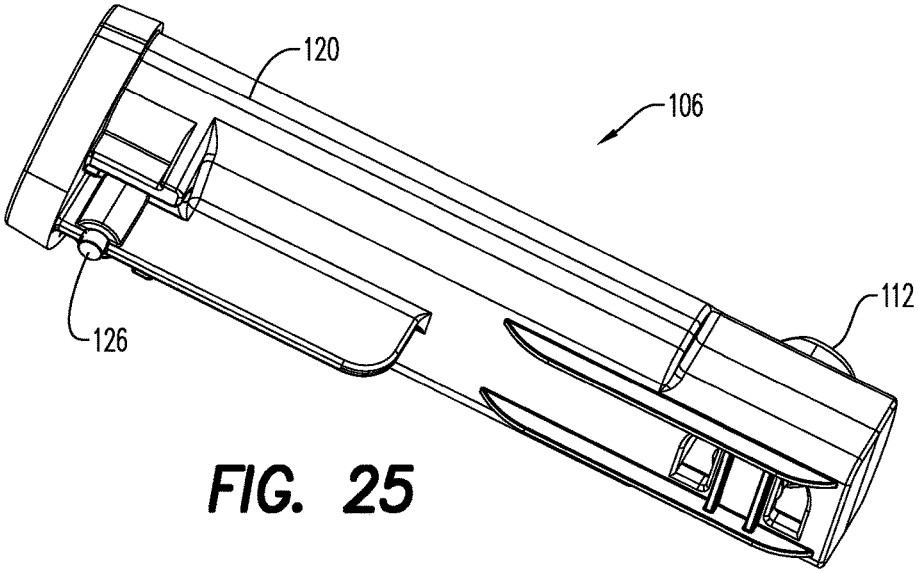
FIG. 25 is a bottom perspective view of the first pole connection assembly of FIG. 23.
Figure 26:
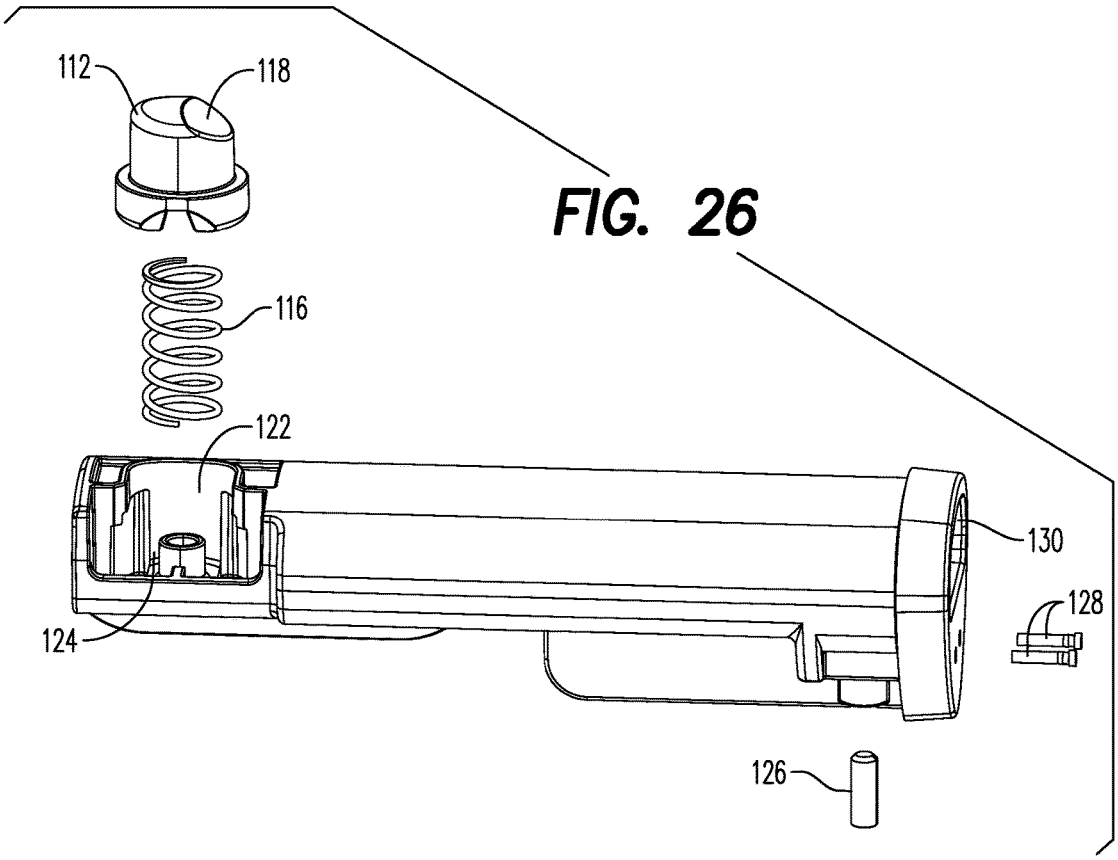
FIG. 26 is a side perspective, exploded view of the first pole connection assembly of FIG. 23.
Figure 27:
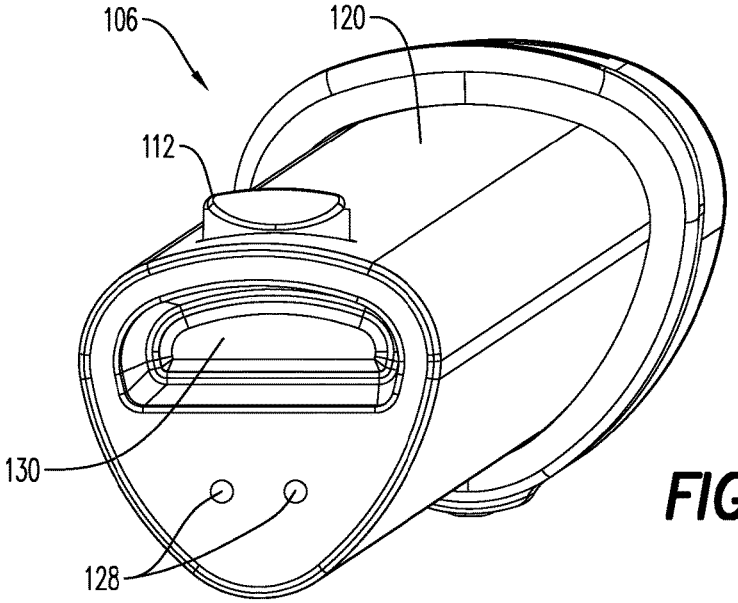
FIG. 27 is an end view of the first pole connection assembly of FIG. 23.
Figure 28:
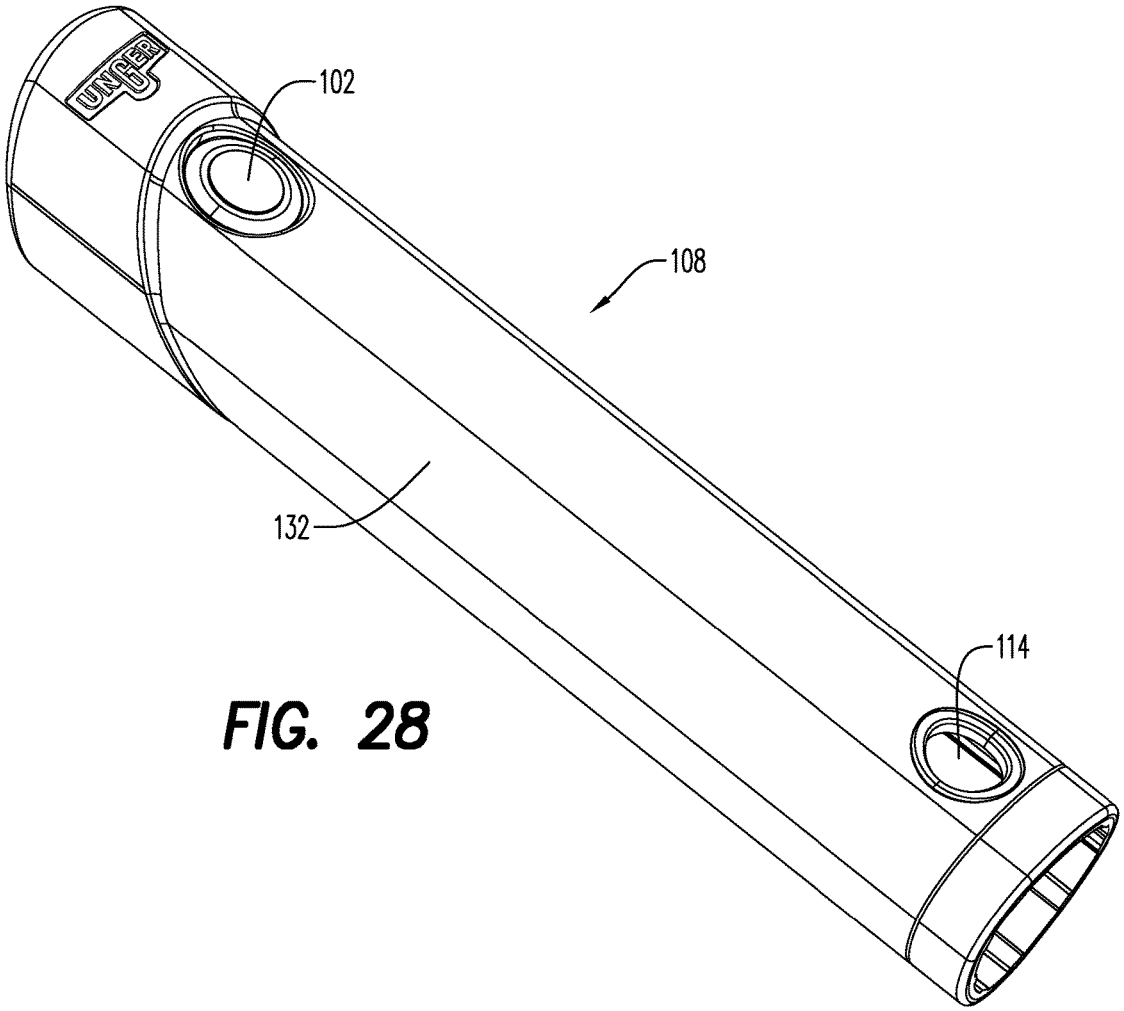
FIG. 28 is a top perspective view of an exemplary embodiment of a second pole connection assembly according to the present disclosure.
Figure 29:
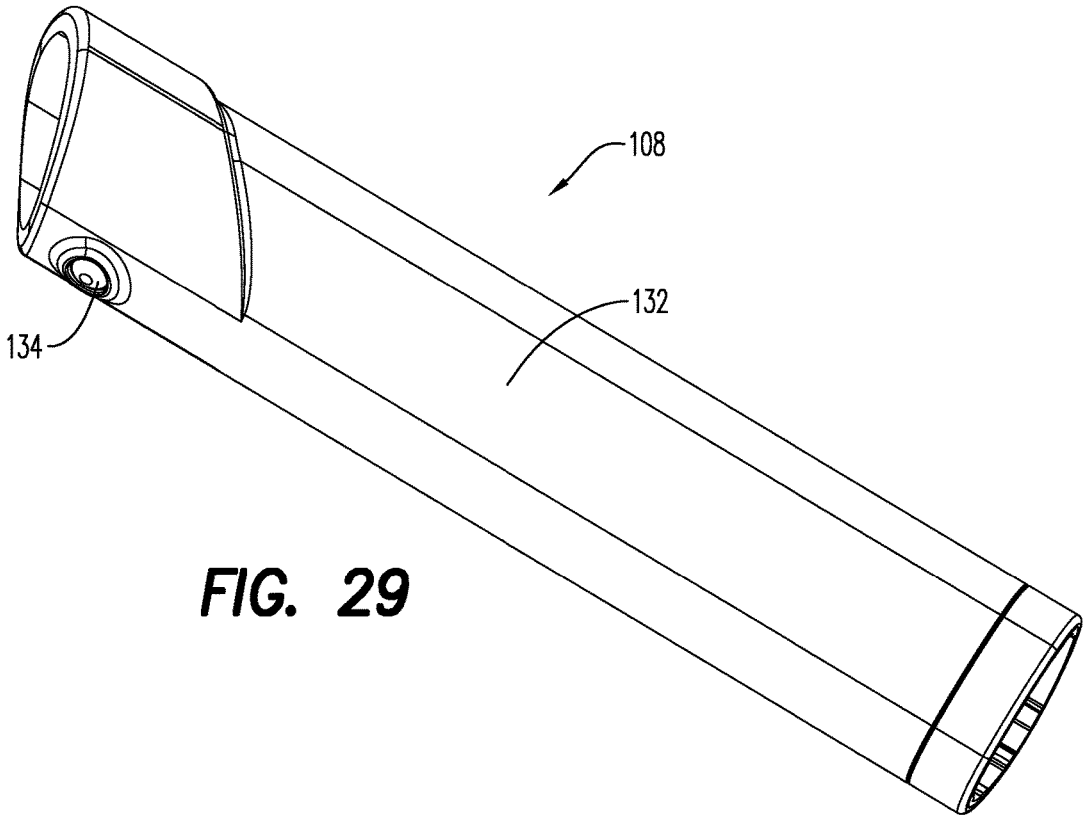
FIG. 29 is a bottom perspective view of the second pole connection assembly of FIG. 28.
Figure 30:
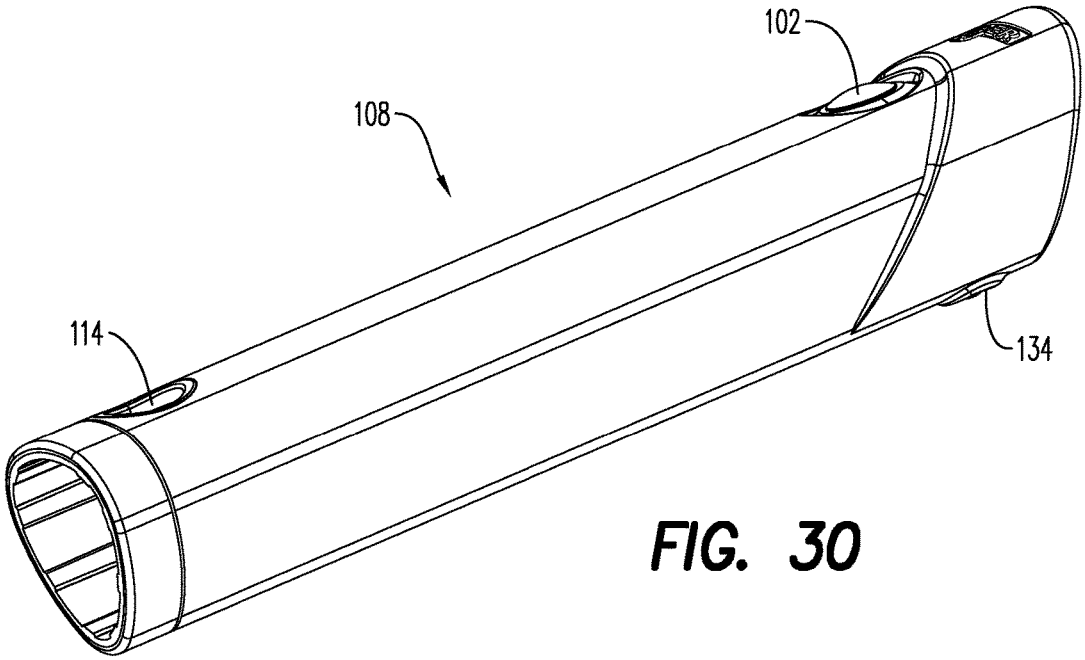
FIG. 30 is a side perspective view of the second pole connection assembly of FIG. 28.
Figure 31:
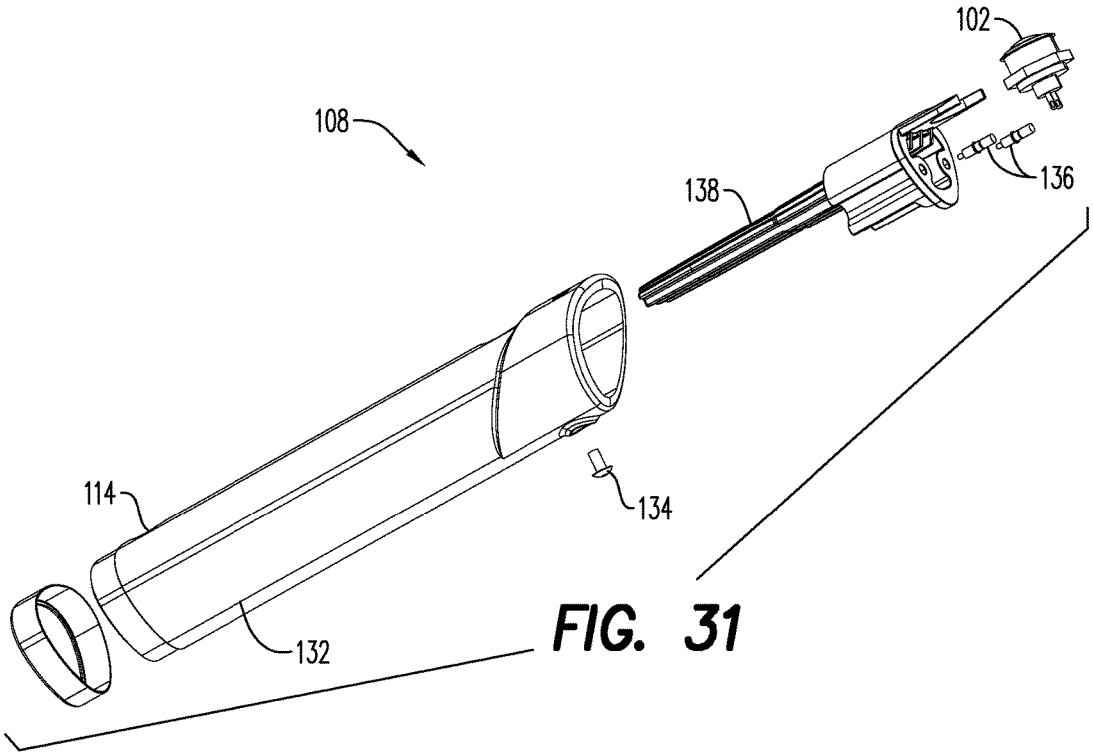
FIG. 31 is a side perspective, exploded view of the second pole connection assembly of FIG. 28.
Figure 32:
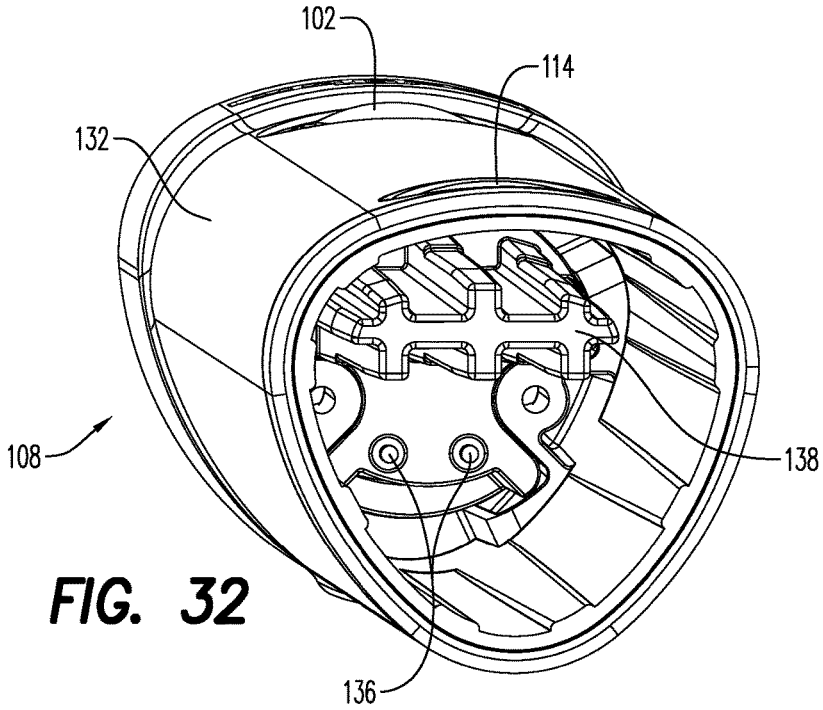
FIG. 32 is an end view of the second pole connection assembly of FIG. 28.

It has been found that, under certain cleaning activities, it may be desired to extend the reach of device 10 provided by handle 16. Accordingly, device 10 is configured for use with one or more extension poles 100 as shown in FIGS. 19-20 of the same or differing sizes.

Each of poles 100 includes an activation button 102 and the poles are configured so that, upon connection of the pole to handle 16 or to another pole 100, the activation button of the pole is placed in electrical communication with activation button of the handle 16. In this manner, pump 50—when device 10 is used with one or more poles 100—can be activated by button 56 on handle 16 and any of the buttons 102 on the poles.

Pole 100 is described in more detail with reference to FIGS. 21-32.

Pole 100 includes an extension member 104, a first pole connection assembly 106, and a second pole connection assembly 108. In the illustrated embodiment, extension member 104 is made of material such as, but not limited to metal (e.g., steel, aluminum), plastics, composite material (e.g., fiber glass, carbon fiber, etc), and other materials.

Member 104 has a hollow region 110 at least in the area of first pole connection assembly 106 in which the assembly is disposed. Of course, it is contemplated by the present disclosure for pole 100 to be entirely hollow.

Figure 33:
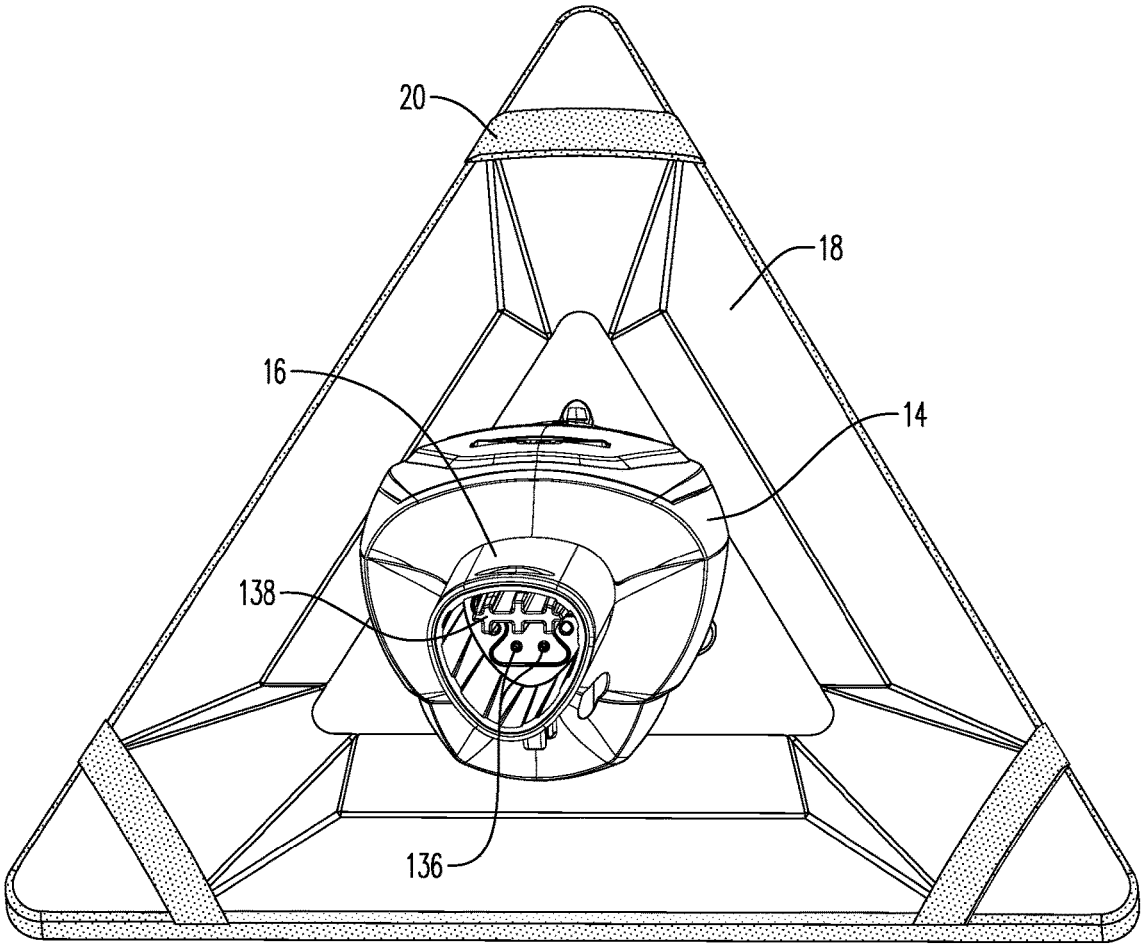
FIG. 33 is an end view of the cleaning device of FIG. 1 illustrating the elements of the second pole connection assembly.

First assembly 106 forms a portion of the physical and electrical interconnection between handle 16 and pole 100, as well as between poles. Similarly, second assembly 108 forms another portion of the physical and electrical interconnection between handle 16 and pole 100. While the second assembly 108 is described by way of example as part of pole 100, the features of the second assembly are also present in handle 16 to allow the first assembly 106 to physically and electrically connect to device 10. Thus, the features of second assembly 108 that are common to those on handle 16 are illustrated in FIG. 33.

Preferably, first assembly 106 is an internal assembly—namely is an assembly that is disposed substantially in the inner diameter of pole 100—while second assembly 108 is an external assembly—namely is an assembly that is disposed substantially around the outer diameter of pole 100. In this manner, the first assembly 106 can be thought of as the "male" portion of the interconnection and the second assembly 108 can be thought of as the "female" portion of the interconnection.

First assembly 106 includes a movable lock 112 that is removably received in a locking opening 114 of second assembly 108. When first assembly 106 is disposed in extension member 104, lock 112 is biased by a biasing member 116 (e.g., spring or other resilient member) through a passage in the extension member. Preferably, lock 112 has a tapered edge 118 that, when abutting the second assembly 108 during connection, acts as a cam surface to urge the button downward into extension member 104 by overcoming the return force of biasing member 116. However when lock 112 is in alignment or registration with locking opening 114 in second member 114, the biasing member 116 returns the lock to its normal, extended position where it resides in the locking opening to prevent separation of the poles 100 or pole 100 and handle 16, respectively.

During disconnection, the user can depress lock 112 overcoming the return force of biasing member 116 so that the lock is free from locking opening 114 in second member 114 to allow separation of the poles 100 or pole 100 and handle 16, respectively.

First assembly 106 includes a main body 120 that has a channel 122 in which lock 112 and biasing member 116 reciprocate vertically. Advantageously, channel 122 is open on at least one side 124, allowing the lock 112 and biasing member 116 to be installed into channel 122 from the side—then retained in position in the channel upon insertion into extension member 104.

First assembly 106 is secured in extension member 104 by way of a transverse pin 126. Further, first assembly 106 includes a pair of electrical contacts 128 and a guide member 130 which are described in more detail below in combination with features of second assembly 108.

Second assembly 108 includes a main body 132 in which locking opening 114 and activation button 102 are disposed. Second assembly 108 is secured over the outer diameter of extension member 104 by way of a transverse pin 134. Second assembly 108 also includes a pair of electrical contacts 136 and a guide member 138.

It is again noted that handle 16 functions in a manner similar to second assembly 108 and, thus, includes the elements of the second assembly necessary to form the desired physical and electrical connection with the first assembly 106 of pole 100. Accordingly, handle 16 includes lock opening 114, electrical contacts 136, and guide member 138 as shown at least in FIG. 33.

During assembly of first and second assemblies 106, 108 (i.e., assembly of two poles 100 to one another) and/or assembly of handle 16 with first assembly 106 (i.e., assembly of handle 16 with one pole 100), the guide members 130, 138 are mated to one another to provide positive location of contacts 128, 136 with respect to one another. The guide members 130, 138 are slid with respect to one another until locking member 112 is received in locking opening 114 to form the desired physical connection. Further and upon the completion of the physical connection, contacts 128, 136 also form an electrical connection therebetween.

It should be recognized that electrical contacts are illustrated as pin type contacts, but of course, it is contemplated by the present disclosure for contacts 128, 136 to be any contact type sufficient to provide the desired electrical conductivity such as, but not limited to, slide contacts.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

PARTS LIST cleaning device 10
cleaning fluid pouch 12
housing 14
handle 16
cleaning head 18
cleaning element 20
spray nozzles 22
central openings 24, 26
cover 28

-continued

| PARTS LIST |
| --- |
| internal cavity 30 |
| connection port 32 |
| closure member 34 |
| pouch port 36 |
| o-ring 38 |
| slit valve 40 |
| upstanding arms 42 |
| pivot axis 44 |
| plate 46 |
| seal 48a |
| bottom 48b |
| pleat 48c |
| pump 50 |
| power source 52 |
| removable cover 54 |
| activation button 56 |
| conduit path 58-1, 58-2 |
| pump inlet 60 |
| pump outlet 62 |
| first pathway 64 |
| second pathway 66 |
| head inlet 68 |
| upper cover 70 |
| lower cover 72 |
| support member 74 |
| port 76 |
| connector 78 |
| pair of supports 80 |
| pivot member 82 |
| first axis 84 |
| pair of arms 86 |
| second axis 88 |
| connector 90 |
| --- 92 |
| --- 94 |
| --- 96 |
| --- 98 |
| extension poles 100 |
| activation button 102 |
| extension member 104 |
| first assembly 106 |
| second assembly 108 |
| hollow region 110 |
| movable lock 112 |
| locking opening 114 |
| biasing member 116 |
| main body 120 |
| channel 122 |
| open side 124 |
| transverse pin 126 |
| electrical contacts 128 |
| guide member 130 |
| main body 132 |
| transverse pin 134 |
| electrical contacts 136 |
| guide member 138 |

What is claimed is:

1. A cleaning device comprising:

a cleaning element having a first spray opening;

a cleaning head having the cleaning element connected thereto;

a housing defining an internal cavity, the cleaning head being connected to the housing;

a pump;

a flexible pouch removably stored in the internal cavity, the flexible pouch forming a fluid and air tight connection with an inlet of the pump and having a cleaning fluid therein; and a spray nozzle having a fluid tight and air tight connection with an outlet of the pump, the spray nozzle being positioned on the cleaning head so as to spray the cleaning fluid from the flexible pouch through the first spray opening onto a surface being cleaned.

2. The cleaning device of claim 1, wherein the pump is an electric pump, the housing further comprising a power source in selective electrical communication with the electric pump.

3. The cleaning device of claim 1, wherein the flexible pouch comprises a liner of a fluid container.

4. The cleaning device of claim 1, wherein the flexible pouch collapses as the cleaning fluid is sprayed by the pump.

5. The cleaning device of claim 1, wherein the cleaning head further comprises a second spray opening, the spray nozzle being positioned on the cleaning head so as to spray the cleaning fluid from the flexible pouch onto the surface being cleaned through the first and second spray openings.

6. The cleaning device of claim 5, wherein the cleaning head and the cleaning element, when the cleaning element is in contact with the surface to be cleaned, trap any spray from the spray nozzle between the cleaning device and the surface to be cleaned.

7. The cleaning device of claim 5, wherein the spray nozzle is positioned on the cleaning head in a position selected from the group consisting of recessed with respect to a bottom of the cleaning head, flush with the bottom of the cleaning head, and extending from the bottom of the cleaning head a distance less than a thickness of the cleaning element.

8. The cleaning device of claim 1, wherein the cleaning element is removably connected to the cleaning head.

9. The cleaning device of claim 8, wherein the cleaning element is a microfiber cleaning cloth.

10. The cleaning device of claim 1, wherein the flexible pouch comprises an internal valve that forms a selective fluid and air tight connection with the inlet of the pump, the internal valve being opened by application of a negative pressure on the flexible pouch by activation of the pump and being closed by resilience of the internal valve upon removal of the negative pressure by deactivation of the pump.

11. The cleaning device of claim 10, wherein the internal valve is the only valve in a fluid path from the flexible pouch through the spray nozzle.

12. The cleaning device of claim 1, further comprising a pouch inlet pivotally secured in the internal cavity, the pouch inlet being removably received in the flexible pouch to form the fluid and air tight connection with the inlet of the pump.

13. The cleaning device of claim 12, wherein the pouch inlet is configured to pivot between a first position and a second position, the first position being sufficient so that the pouch inlet faces out of the internal cavity for connection and removal of the flexible pouch to and from the pouch inlet, the second position being sufficient so that the pouch inlet faces into the internal cavity for storage of the flexible pouch in the internal cavity.

14. The cleaning device of claim 1, wherein the cleaning head and the cleaning element are triangular.

15. The cleaning device of claim 1, wherein the cleaning head is removably and pivotally connected to the housing.

16. The cleaning device of claim 15, further comprising a pivot member connected to a pair of supports for movement about a first axis and connected by a connector to a pair of arms for movement about a second axis, wherein the connector is removable to allow the cleaning head and pivot member to be removed from the housing.

17. The cleaning device of claim 16, wherein the connector comprises a shoulder bolt extending through and structurally supporting the pivot member.

18. The cleaning device of claim 1, wherein the housing further comprises an activation button for pumping fluid from the flexible pouch.

19. The cleaning device of claim 2, wherein the housing further comprises an activation button for selectively placing the pump and the power source in electrical communication.

20. The cleaning device of claim 19, wherein the housing further comprises a handle configured to receive an extension pole, the extension pole including a first end connectable to the handle and a second end, the second end having an supplement activation button that, when the extension pole is connected to the handle, can selectively place the pump and the power source in electrical communication.

21. The cleaning device of claim 2, wherein the housing further comprises a handle configured to receive an extension pole, the extension pole including a first end connectable to the handle and a second end, the second end having an activation button that, when the extension pole is connected to the handle, can selectively place the pump and the power source in electrical communication.

22. A cleaning device comprising:

a cleaning element;

a cleaning head having the cleaning element connected thereto;

a housing connected to the cleaning head, the housing defining an internal cavity;

a pump in fluid communication with a pouch port;

a flexible pouch removably stored in the internal cavity, the flexible pouch removably receiving the pouch port to form a removable fluid and air tight connection, the flexible pouch comprising an internal valve that forms a selective fluid and air tight connection with an inlet of the pump; and a spray nozzle having a fluid tight and air tight connection with an outlet of the pump, the spray nozzle being positioned on the cleaning head so as to spray a cleaning fluid from the flexible pouch onto a surface being cleaned.

23. The cleaning device of claim 22, wherein the pump is an electric pump, the housing further comprising a power source in selective electrical communication with the electric pump.

24. The cleaning device of claim 22, wherein the flexible pouch comprises a liner of a fluid container.

25. The cleaning device of claim 22, wherein the flexible pouch collapses as the cleaning fluid is sprayed by the pump.

26. The cleaning device of claim 23, wherein the internal valve is normally closed when the pump and the power source are not in electrical communication and is opened by a negative pressure applied on the flexible pouch when the pump and the power source are in electrical communication.

27. The cleaning device of claim 22, wherein the internal valve is the only valve in a fluid path from the flexible pouch through the spray nozzle.

28. The cleaning device of claim 22, wherein the cleaning element comprises a first spray opening and the cleaning head comprises a second spray opening, the cleaning element being removably connected to the cleaning head, the spray nozzle being positioned on the cleaning head so as to spray the cleaning fluid from the flexible pouch onto the surface being cleaned through the first and second spray openings.

29. The cleaning device of claim 28, wherein the cleaning head and the cleaning element, when the cleaning element is in contact with the surface to be cleaned, trap any spray from the spray nozzle between the cleaning device and the surface to be cleaned.

30. The cleaning device of claim 22, wherein the pouch port is configured to pivot between a first position and a second position, the first position being sufficient so that the pouch port faces out of the internal cavity for connection and removal of the flexible pouch to and from the pouch port, the second position being sufficient so that the pouch port faces into the internal cavity for storage of the flexible pouch in the internal cavity.

31. The cleaning device of claim 22, further comprising a pivot member connected to a pair of supports of the cleaning head for movement about a first axis and connected by a connector to a pair of arms of the housing for movement about a second axis, wherein the connector is removable to allow the cleaning head and pivot member to be removed from the housing.

32. The cleaning device of claim 23, wherein the housing further comprises an activation button for selectively placing the pump and the power source in electrical communication.

33. The cleaning device of claim 32, wherein the housing further comprises handle configured to receive an extension pole, the extension pole including a first end connectable to the handle and a second end, the second end having an activation button that, when the extension pole is connected to the handle, can selectively place the pump and the power source in electrical communication.

34. The cleaning device of claim 22, wherein the housing further comprises handle configured to receive an extension pole, the extension pole including a first end connectable to the handle and a second end, the second end having a supplemental activation button that, when the extension pole is connected to the handle, can selectively place the pump and the power source in electrical communication.

35. A cleaning device comprising:

a cleaning element having a first spray opening;

a cleaning head having a second spray opening, the cleaning element being connected to the cleaning head;

a housing connected to the cleaning head;

a pump;

a container of cleaning fluid forming a fluid and air tight connection with the pump; and a spray nozzle having a fluid tight and air tight connection with the pump so that the pump is configured to spray fluid from the container through the first and second spray openings onto a surface to be cleaned, wherein the cleaning head, the cleaning element, and the spray nozzle define a cavity sufficient so that when the cleaning element is in contact with the surface to be cleaned any spray from the spray nozzle is trapped between the cleaning device and the surface to be cleaned, wherein the container of cleaning fluid comprises a flexible pouch, the flexible pouch collapsing as fluid is sprayed by the pump.

36. The cleaning device of claim 35, wherein the spray nozzle is positioned on the cleaning head in a position selected from the group consisting of recessed with respect to a bottom of the cleaning head, flush with the bottom of the cleaning head, and extending from the bottom of the cleaning head a distance less than a thickness of the cleaning element.

* * * * *